US009487985B2

(12) United States Patent
Conley et al.

(10) Patent No.: US 9,487,985 B2
(45) Date of Patent: Nov. 8, 2016

(54) MOVABLE CLOSURE SYSTEM

(71) Applicant: Adam Conley, Billings, MT (US)

(72) Inventors: Adam Conley, Billings, MT (US); Robert Carrasca, Seattle, WA (US); Christopher Hamlin, Seattle, WA (US)

(73) Assignee: Adam Conley, Billings, MT (US)

( * ) Notice: Subject to any disclaimer, the term of this patent is extended or adjusted under 35 U.S.C. 154(b) by 0 days.

(21) Appl. No.: 15/150,164

(22) Filed: May 9, 2016

(65) Prior Publication Data

US 2016/0251885 A1 Sep. 1, 2016

Related U.S. Application Data

(60) Provisional application No. 62/158,149, filed on May 7, 2015.

(51) Int. Cl.

| | |
|---|---|
| ***E05D 15/06*** | (2006.01) |
| ***E06B 3/50*** | (2006.01) |
| ***E05D 15/26*** | (2006.01) |

(52) U.S. Cl.

CPC ..... *E05D 15/0604* (2013.01); *E05D 15/063* (2013.01); *E05D 15/0647* (2013.01); *E05D 15/0652* (2013.01); *E05D 15/26* (2013.01); *E06B 3/509* (2013.01); *E06B 3/5072* (2013.01);

(Continued)

(58) Field of Classification Search

CPC .. E05D 15/0604; E06B 3/5072; E06B 3/509
See application file for complete search history.

(56) References Cited

U.S. PATENT DOCUMENTS 3,060,521 A * 10/1962 Greco ..... E04B 2/827 160/201

3,303,612 A * 2/1967 Baker ..... E05D 15/58 49/127

(Continued)

FOREIGN PATENT DOCUMENTS

DE EP 2639391 B1 * 11/2013 ..... E05D 15/0604
EP 1496182 1/2005

(Continued)

OTHER PUBLICATIONS

Written Opinion of International Search Authority.

(Continued)

*Primary Examiner* — Katherine Mitchell
*Assistant Examiner* — Marcus Menezes
(74) *Attorney, Agent, or Firm* — Puget Patent; Michael Gibbons

(57) ABSTRACT

Improvements to movable closure systems which aid installability and reliability of said systems can include wheels running along the top and bottom of individual slidable elements, the wheels oriented horizontally and disposed within a track configured for receiving the horizontal wheels. The horizontal wheels reduce the vertical profile of the track-engaging portions of the slidable elements, enabling more of the slidable element to be used for glass or other aesthetically-preferable transparent materials. A track leveling system enables installers to more easily deploy and properly tune the system between floors and casings which are not perfectly flush. A compression jamb permits closure of the system via slidable elements pressing into the jamb to deflect it in order to better seal the closure comprised of the individual slidable elements. A durable hinge mechanism permits the sliding elements to rotate in order to stack the sliding elements at one end of the system.

20 Claims, 31 Drawing Sheets

(52) U.S. Cl.
CPC ..... *E05Y 2900/132* (2013.01); *E05Y 2900/148* (2013.01); *E05Y 2900/15* (2013.01)

(56) References Cited

U.S. PATENT DOCUMENTS

| | | | | |
|---|---|---|---|---|
| 3,334,375 | A * | 8/1967 | Hubbard | E05D 15/0608 16/100 |
| 3,879,799 | A | 4/1975 | Williams | |
| 5,058,321 | A * | 10/1991 | Harbom | E05D 15/0604 49/177 |
| 5,272,839 | A * | 12/1993 | Karhu | E05D 15/58 16/95 R |
| 5,448,855 | A * | 9/1995 | Sjoholm | E05D 15/0621 160/201 |
| 5,548,926 | A * | 8/1996 | Sjoholm | E05D 15/58 49/125 |
| 5,749,172 | A * | 5/1998 | Isopahkala | E05D 15/0604 49/124 |
| 6,397,522 | B1 * | 6/2002 | Nussbaum | E05D 15/58 49/127 |
| 6,487,753 | B1 | 12/2002 | Lonnberg | |
| 6,553,715 | B1 * | 4/2003 | Lonnberg | E05D 15/0608 160/196.1 |
| 6,618,994 | B1 * | 9/2003 | Nussbaum | E05D 15/58 292/171 |
| 8,819,994 | B2 | 9/2014 | Ingram | |
| 2011/0088326 | A1 | 4/2011 | Ingram | |
| 2016/0040474 | A1 * | 2/2016 | Geng | E06B 3/5072 49/177 |

FOREIGN PATENT DOCUMENTS

| | | | | |
|---|---|---|---|---|
| ES | EP 1795682 | A2 * | 6/2007 | E05D 15/0613 |
| FI | WO 2006111613 | A1 * | 10/2006 | E05D 15/0604 |
| JP | 3480934 | B2 * | 12/2003 | E05D 15/58 |

OTHER PUBLICATIONS

International Search Report.

* cited by examiner

FIG. 3g
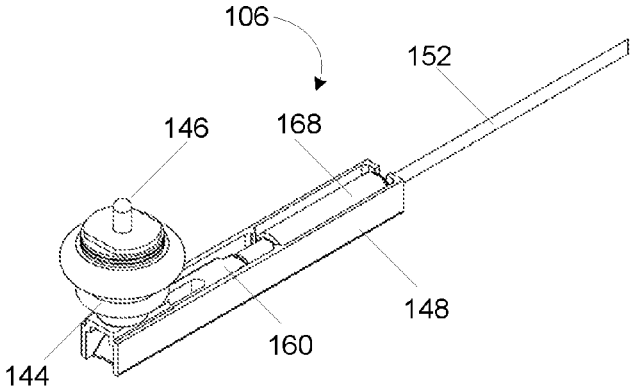
FIG. 3h
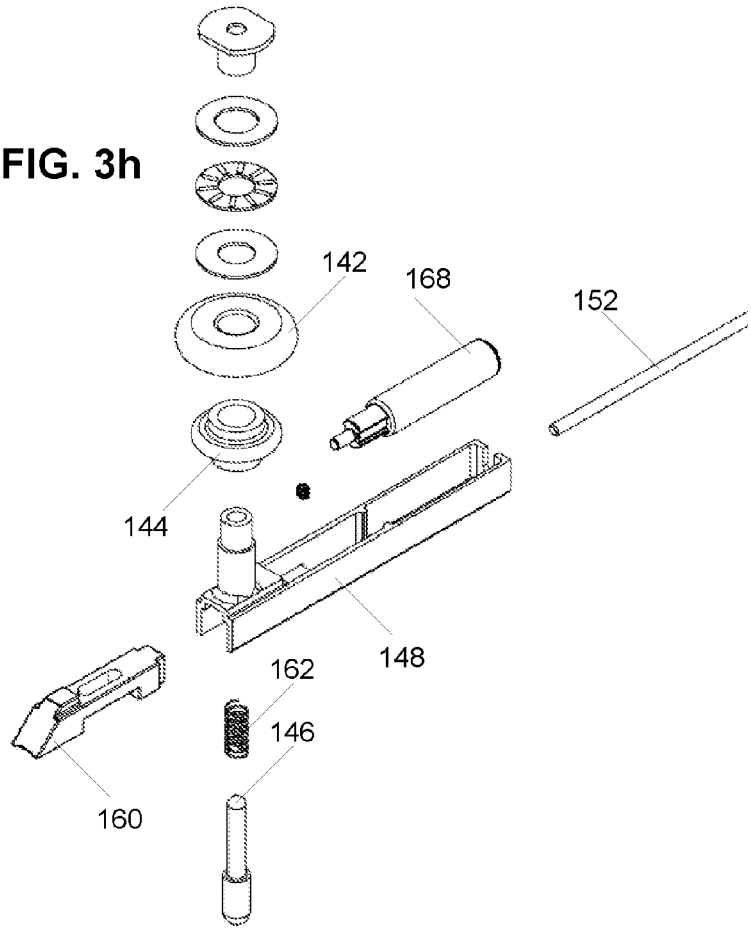
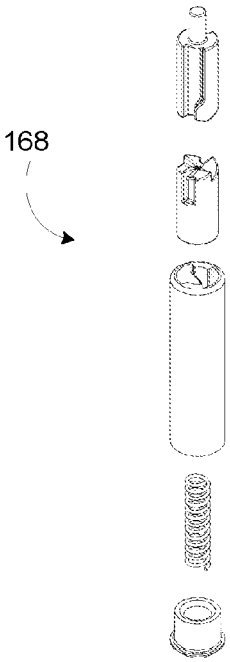
FIG. 3k

FIG. 3i
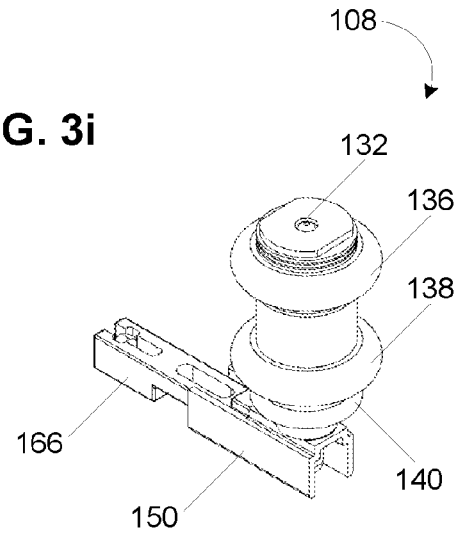
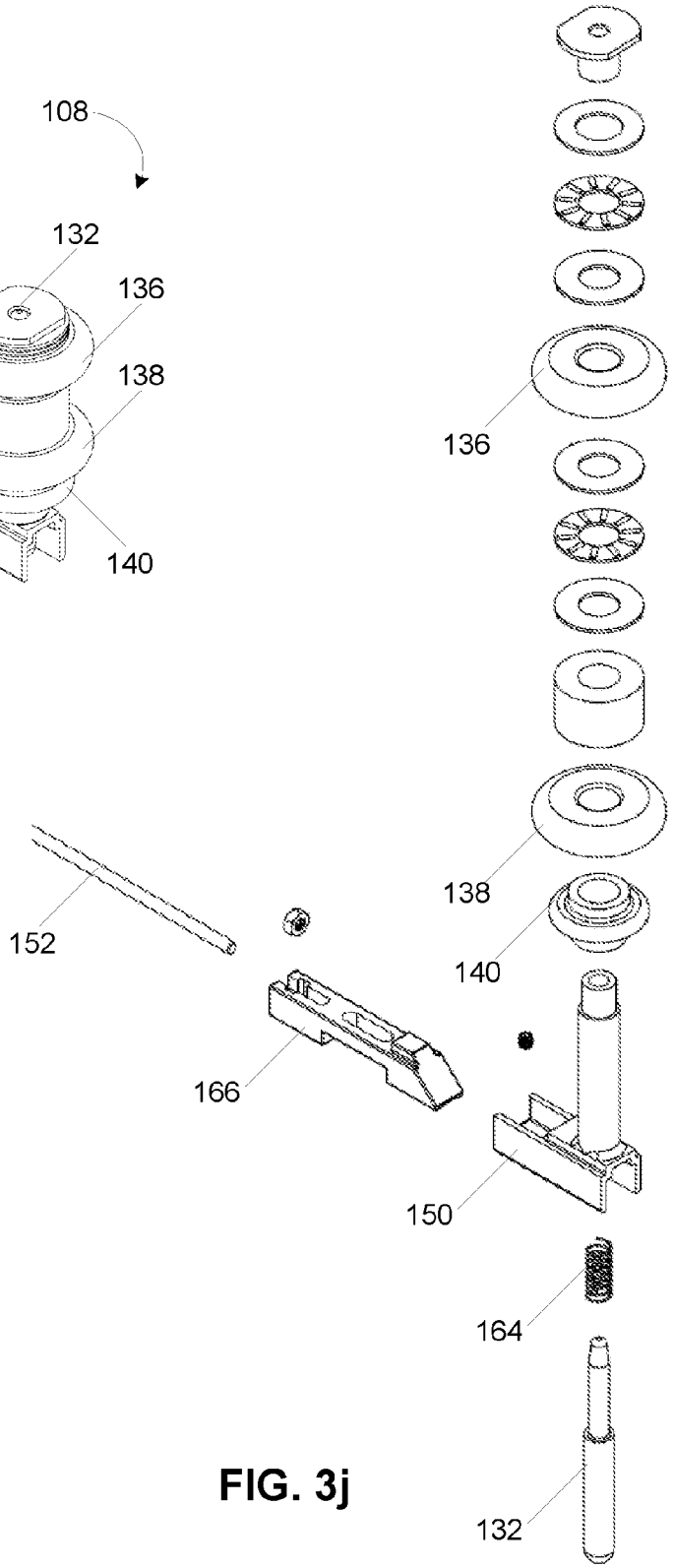
FIG. 3j

FIG. 12a
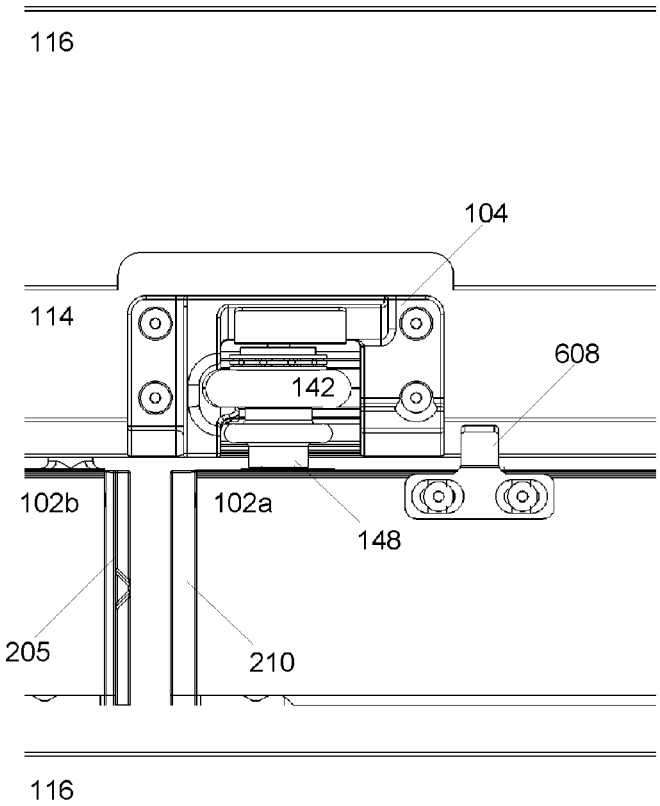
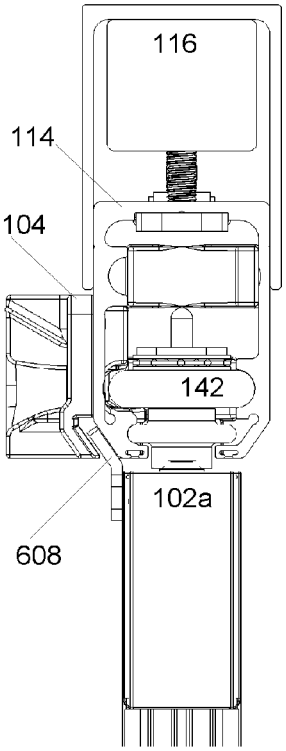
FIG. 12c
FIG. 12b
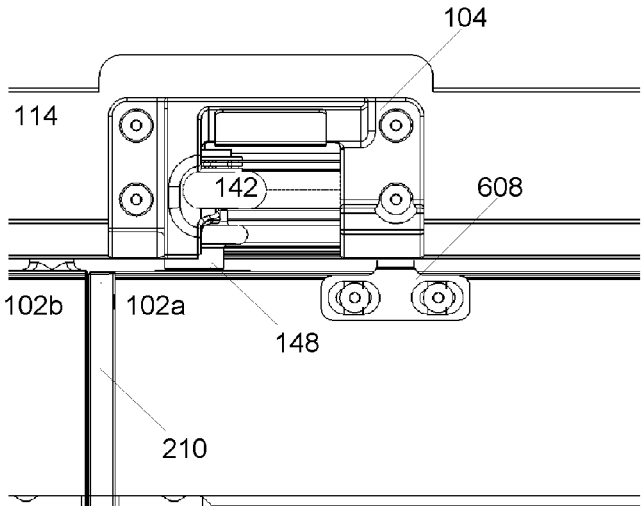

MOVABLE CLOSURE SYSTEM

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a non-provisional of U.S. Provisional Patent Application No. 62/158,149, entitled ELEMENTS OF A MOVABLE CLOSURE SYSTEM, naming Adam Conley, Robert Carrasca and Christopher Hamlin as inventors, filed May 7, 2015, which is currently or is an application of which a currently application is entitled to the benefit of the filing date.

FIELD OF THE INVENTION

This invention relates generally to movable closures and, more specifically, to a movable closure system.

BACKGROUND

Windows and doors may be implemented through movable closure systems, which may include one or more slidable elements. Advances in movable closure systems increase the installability and reliability of such systems. Movable closure systems are often customized to fit a particularly-sized aperture through a structure. Providing components which can expand or contract as needed to fit a particular aperture while still providing a tight seal when the system is closed is beneficial. In addition, most movable closure systems enable a view of the outside from within the structure by virtue of use of transparent or semi-transparent panels within the slidable elements. To maximize viewing ability, aspects of the slidable elements other than the panels may be optimized in size. Floor to ceiling panels may be large, necessitating use of heavy glass, so aspects of the system which support glass panels must be sturdy and durable while providing the ability to slide the panels back and forth easily despite the weight of the panels. As with a doorway into a home, business, or other building in which a movable closure system might be installed, locking features are necessary to ensure security. Disclosed herein is a movable closure system produced in view of some of the foregoing objectives.

Technical materials which can be regarded as useful for the understanding, searching, and examination of the invention includes:

U.S. Pat. No. 5,448,855 (Sjoholm), "Sliding Element System," 1995.

U.S. Pat. No. 8,819,994 (Ingram), "Space Enclosure System," 2014.

The foregoing disclosures are hereby incorporated by reference.

SUMMARY

This invention relates generally to movable closures and, more specifically, to a movable closure system. In some embodiments, a movable closure system includes, but is not limited to, a plurality of slidable elements supported from above by an adjustable upper track and from below by an adjustable lower track. The width of a slidable element may be aligned with the tracks (a "closed" position of the slidable element) and the slidable elements may slide back and forth on wheels engaging the tracks. The adjustable upper and lower track may have one or more channels running laterally (i.e. from one end of the track to the other) through them. The lateral channels may be configured to permit horizontal wheels of the slidable elements to traverse the tracks. The horizontal wheels may have rounded edges mating with rounded edges of the lateral channels.

A slidable element may have an axis of rotation adjacent to one side of the slidable element, the axis of rotation being disposed from the top to the bottom of the slidable element and about which the slidable element may pivot. The axis of rotation may extend through an upper wheel assembly and a lower wheel assembly of the slidable element. Pivoting a slidable element would rotate it such that the width is no longer aligned with the tracks (an "open" position of the slidable element). The pivot may include a rotation of the slidable element to an angle of up to 90 degrees from the tracks.

Each slidable element may be configured with a particular lateral location at which that slidable element may be pivoted. The locations where each slidable element may be pivoted may be adjacent to one end of the system, called the stacking end. Upon each slidable element being slidably moved to its particular lateral location adjacent to the stacking end of the system and pivoted about its axis of rotation, a "stack" of adjacent slidable elements rotated to a perpendicular orientation to the track is created and the system is opened. The opposing end of the system to the stacking end is called the closure end.

In some embodiments, the adjustable upper track and the adjustable lower track include structures for engaging each particular slidable element at a different lateral location where the particular slidable element may rotate. The system is configured to permit each slidable element to rotate only at the particular lateral location intended for that slidable element. The foregoing structures may include, but are not limited to, an insert guide within the adjustable upper track configured to permit a free wheel assembly of each slidable element to exit the adjustable upper track when the slidable element is slidably moved to the location at which it is intended to pivot. The foregoing structures may also include a hinge block within the adjustable upper track configured to engage a portion of an upper hinge wheel assembly of each slidable element to facilitate the rotation of the slidable element at the location at which it is intended to pivot.

The foregoing structures may also include a hinge block within the adjustable lower track configured to engage a portion of a lower hinge wheel assembly of each slidable element to facilitate the rotation of the slidable element at the location at which it is intended to pivot. The foregoing structures may also include distances between the free wheel assembly and upper hinge wheel assembly that are staggered for each adjacent slidable element. The foregoing structures may also include mechanisms for raising a locator pin of an upper hinge wheel assembly into a corresponding locator hole of the hinge block disposed within the adjustable upper track to provide additional support for the suspension of the slidable element through its axis of rotation, the raising occurring in response to the slidable element being pivoted and the free wheel assembly exiting the insert guide.

In some embodiments, the system may include structures for ensuring a tight seal exists between each slidable element and between the slidable elements and the jambs to each side of the system, the jambs at least partially providing the edges of the system from the adjustable top track to the adjustable bottom track. The foregoing structures may include, but are not limited to, a static jamb adjacent to the closure end of the system and configured for enabling an installer of the system to vary the lateral position of one edge of the system against which the adjacent slidable element will rest when the system is closed. The foregoing structures may include, but are not limited to, a compression jamb configured for enabling a user of the system to extend the jamb laterally, away from the stacking end of the system, and pressing against the slidable element adjacent to the stacking end when the system is closed. The pressure exerted by the compression jamb pushing against the "first" slidable element (the slidable element which opens first and is located adjacent to the stacking end of the system and adjacent to the compression jamb) is transferred to each slidable element in turn, compressing the slidable elements together and against the static jamb. The foregoing structures may include, but are not limited to, compressible weatherstrips between the slidable elements. A weatherstrip may also be disposed on the static jamb and/or on the compression jamb. The foregoing structures may include, but are not limited to, male and female endcaps between one or more of the slidable elements, the static jamb, and/or the compression jamb, the male and female endcaps interlocking in both a horizontal and vertical axis to assist with the sealing and security of the system when closed.

In some embodiments, the system may include structures for providing additional security of the system when closed. The foregoing structures may include the compression jamb which is configured for ensuring that no free wheel assembly is aligned with the insert guide when the system is closed, a first panel interlock engaging a portion of the insert guide when the compression jamb is operated, and a latch of the compression jamb which, when operated from "inside" the structure in which the movable closure system is installed, prevents a handle of the compression jamb from being operated to open the system.

In addition to the foregoing, various other methods, systems and/or program product embodiments are set forth and described in the teachings such as the text (e.g., claims, drawings and/or the detailed description) and/or drawings of the present disclosure.

The preceding is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings, presented in accordance with varied embodiments of the invention:

FIGS. 3*g* and 3*h* are a perspective view and an exploded perspective view of the free wheel assembly.

FIGS. 3*i* and 3*j* are a perspective view and an exploded perspective view of the upper hinge wheel assembly.

FIG. 3*k* is an exploded view of a clicker subassembly of the free wheel assembly.

FIGS. 12*a*, 12*b*, and 12*c* are two front views and a right side view of a portion of the movable closures system.

DETAILED DESCRIPTION

This invention relates generally to movable closures and, more specifically, to elements of a movable closure system. Specific details of certain embodiments of the invention are set forth in the following description and in FIGS. 1-14*b* to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1A:
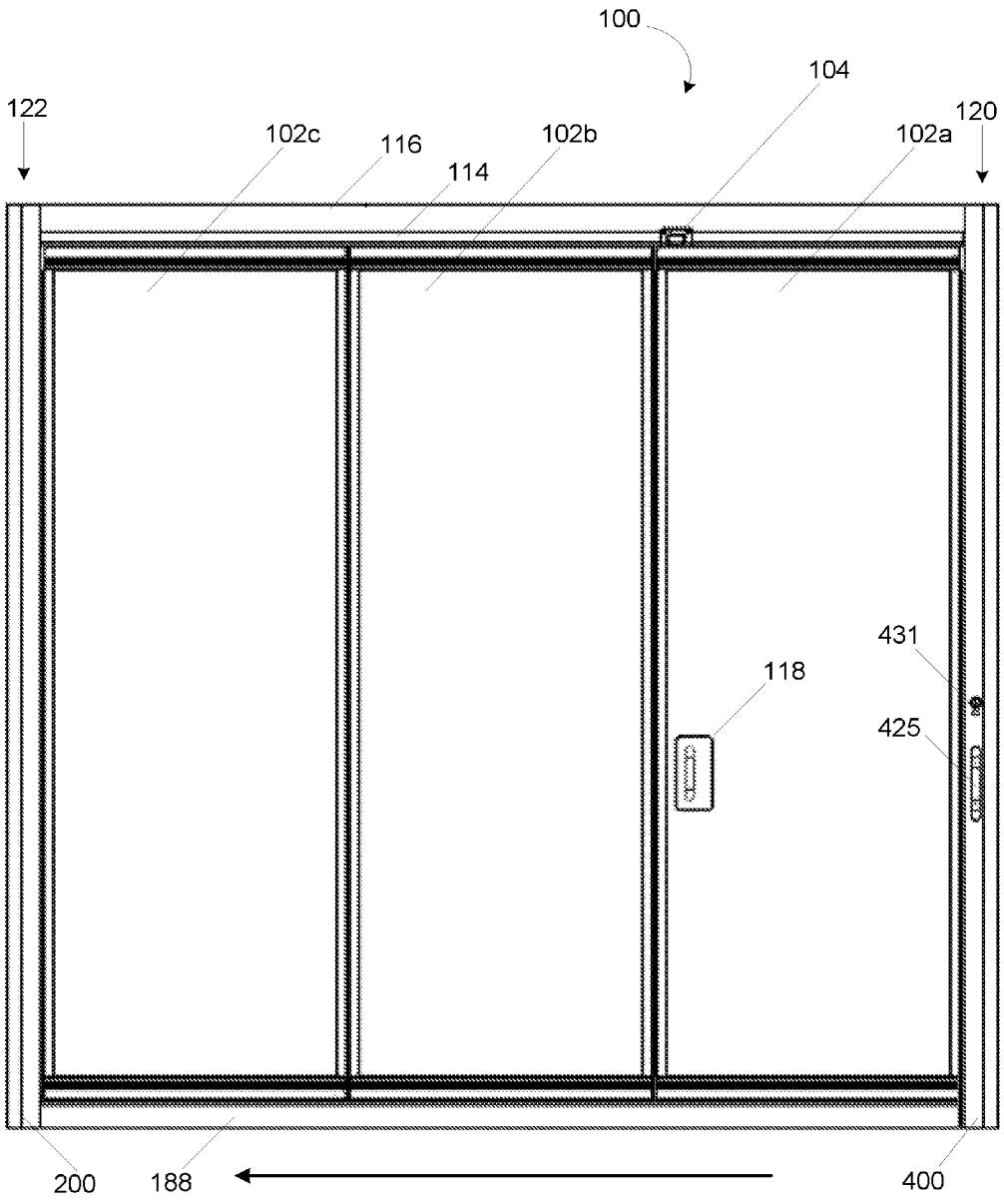
FIG. 1*a* is a front view of a movable closure system 100.

FIG. 1*a* is a front view of a movable closure system 100, in accordance with an embodiment of the invention. FIGS. 1*b*, 1*c*, 1*d*, 1*e*, 1*f*, 1*g*, 1*h*, 1*i*, and 1*j* are perspective views of a movable closure system 100, in accordance with an embodiment of the invention. FIGS. 1*a*-1*j* show the movable closure system 100 as seen from "inside" a structure in which the movable closure system 100 is installed. FIG. 1*j* is included to show a view from which various cross sections depicted elsewhere herein are taken.

In some embodiments, the movable closure system 100 is a system of slidable elements 102. Depicted in FIGS. 1*a*-1*i* are three slidable elements, 102*a*, 102*b*, and 102*c*. Of course, more slidable elements or even fewer (as few as one) slidable elements may be employed to fit a differently-sized aperture or for other reasons. The number of slidable elements depicted in the drawings and accompanying discussion is merely for convenience of understanding and is intended to be non-limiting in nature. The slidable elements may be rectangular.

The slidable elements are below an adjustable upper track, which is formed from upper rail 114 and C-channel 116. The slidable elements are above an adjustable lower track, which includes lower rail 188. The slidable elements are laterally between a static jamb 200 and a compression jamb 400. In some embodiments, the movable closure system 100 may be deployed as a door, a window, or as another type of closure of an aperture through a structure.

An arrow is present in FIGS. 1*a*-1*i* below the depiction of the system to indicate the direction of travel of slidable elements 102 when closing the movable closure system 100. Furthermore, the arrows will be present in additional drawings to assist a viewer in understanding which side (inside or outside) of the movable closure system 100 is in view. FIGS. 1*a*-1*i*, having an arrow pointing to the left, depict the system from the "inside." Drawings which show the arrow pointing to the right depict the system from the "outside." Of course, "inside" and "outside" are used here in a non-limiting way; it is envisioned that the system could be flipped around for installation (e.g. with the insert guide 104 disposed through upper rail 114 facing the other direction).

FIG. 1*a* shows the movable closure system in a closed configuration. When the system is closed, the slidable elements are compressed together from the side through operation of compression jamb 400. By operating handle 425 during closing of the system, a portion of the compression jamb expands to the left, pressing against the right side of the rightmost slidable element 102*a*. Slidable element 102*a* in turn presses against slidable element 102*b*, which presses against slidable element 102*c*, which presses against the static jamb 200. Each of the left and right edges of the slidable element includes a compressible weatherstrip, as does the static jamb. As a result, when the compression jamb is operated, the weatherstrips between the slidable elements are compressed and a tight, weatherproof seal is formed between the slidable elements and the jambs on either side of the system. Latch 431 may then be operated to lock the system so that it may not be opened from the outside. In some embodiments, a first panel interlock 608 is present. As may be seen in FIG. 1*b*, the interlock is disposed near the top edge of the slidable element closest to the compression jamb. The interlock is a vertical tab which fits underneath a hanging vertical portion of insert guide 104. When the compression jamb is operated, the adjacent slidable element slides away from the compression jamb and the first panel interlock comes to rest underneath the insert guide, providing an additional locking aspect.

Figure 1B:
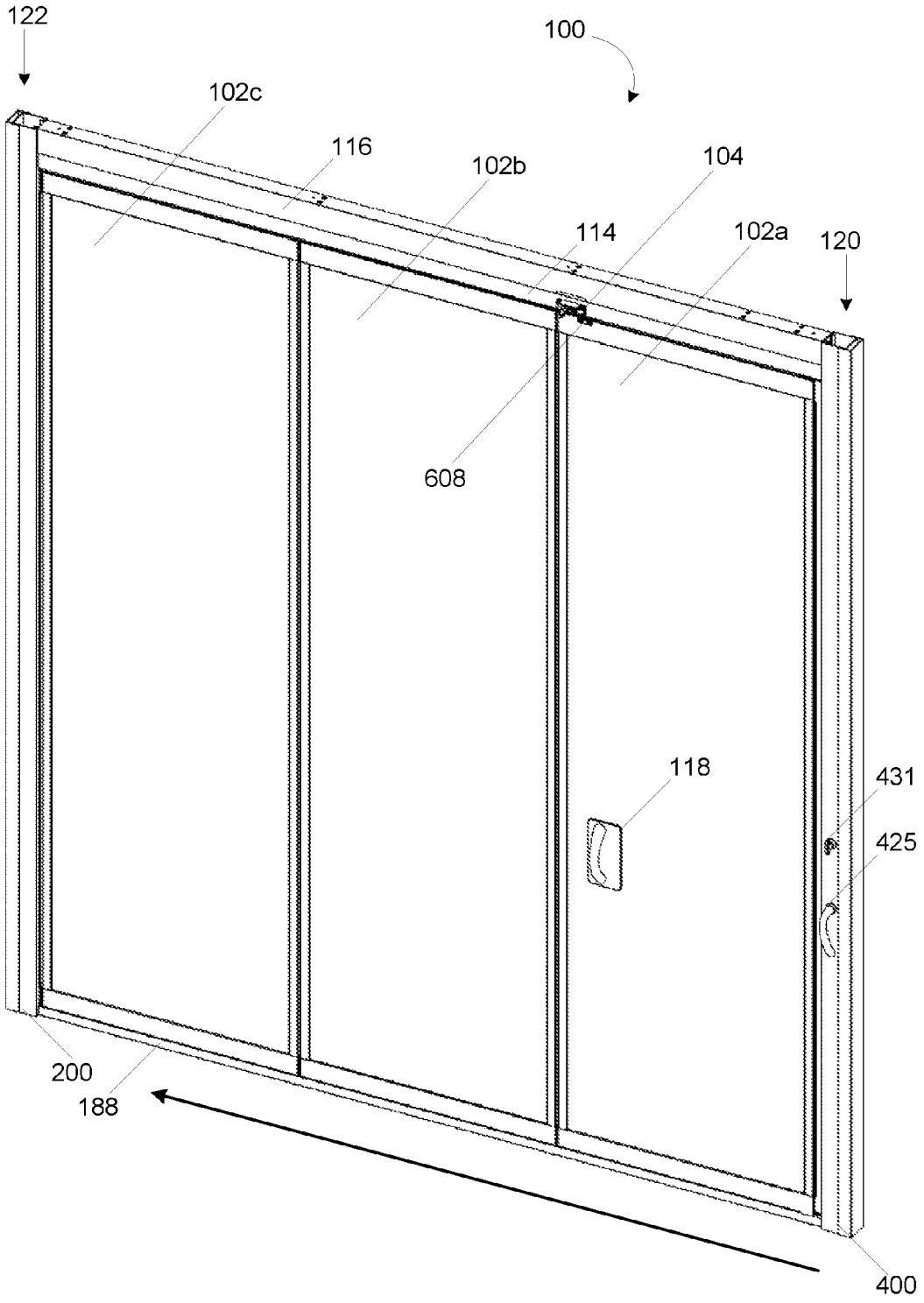
FIGS. 1*b*, 1*c*, 1*d*, 1*e*, 1*f*, 1*g*, 1*h*, 1*i*, and 1*j* are perspective views of a movable closure system.
Figure 1C:
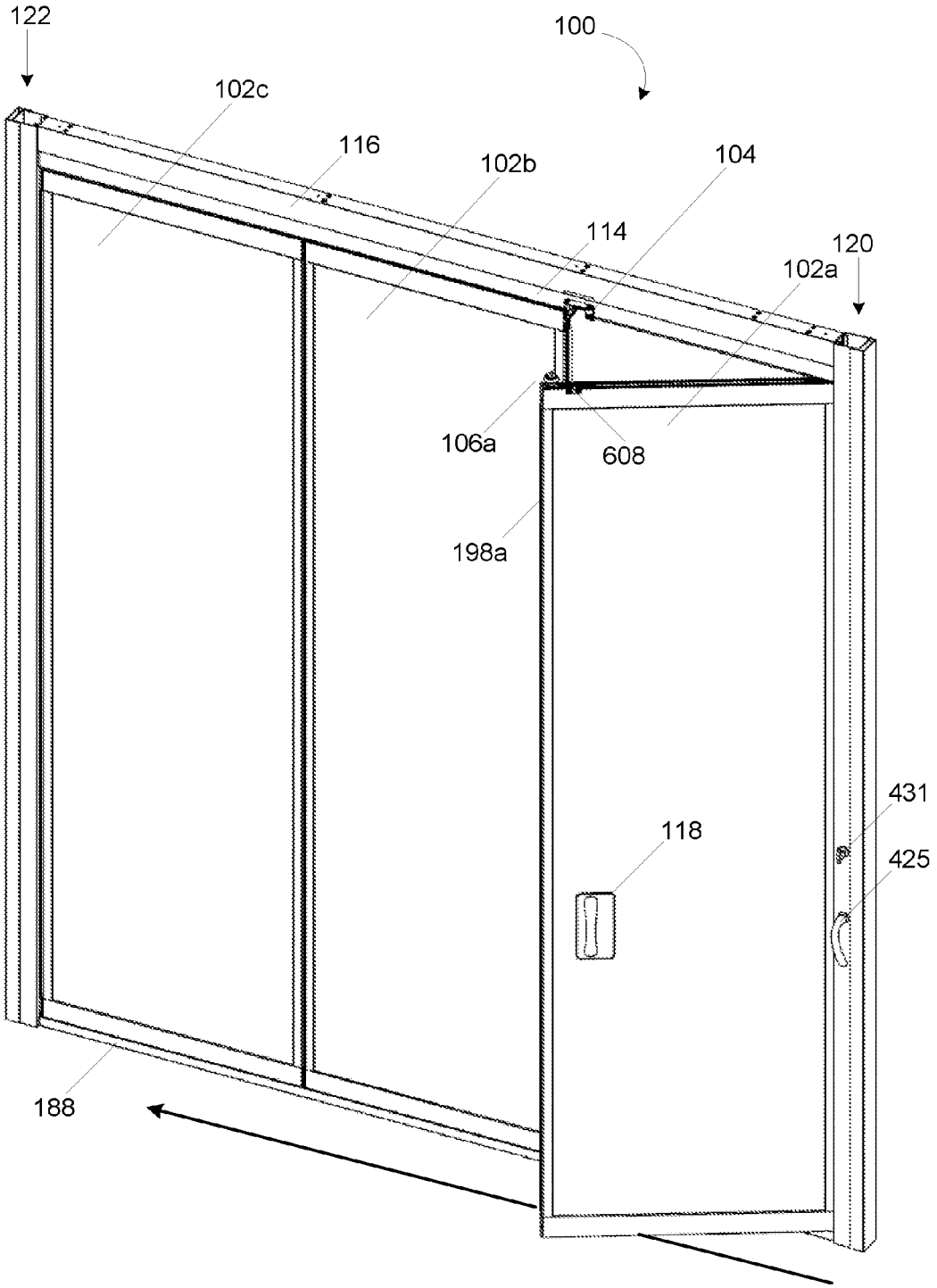
Figure 1D:
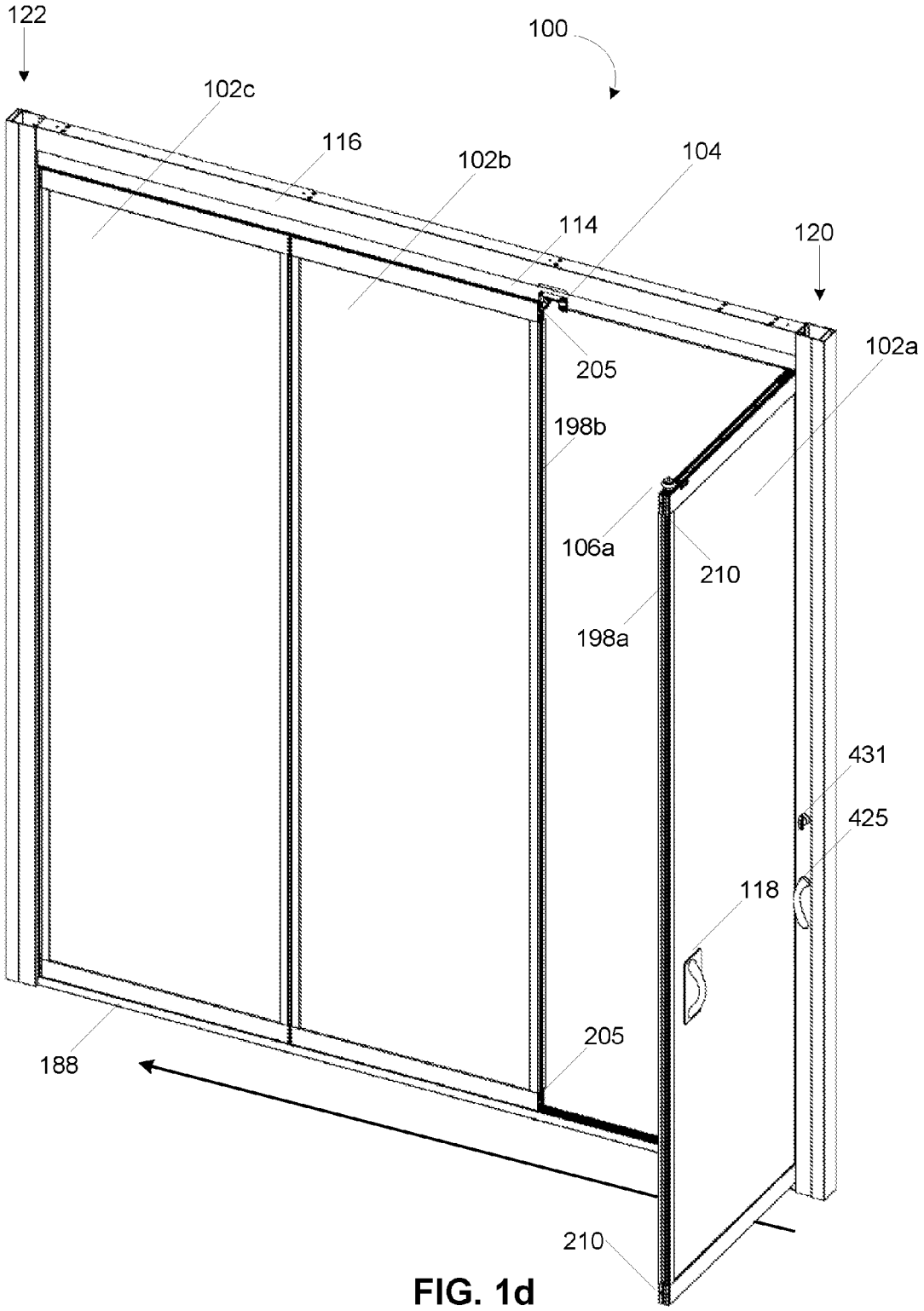

FIGS. 1*b*-1*i* depict the operation of opening the movable closure system 100. (The aforementioned weatherstrip 198 along each side of the slidable elements may be seen in FIGS. 1*c* and 1*d*.) Successive slidable elements 102 may be slidably moved into an opening position and pivoted about a hinge axis unique to each slidable element 102. FIGS. 1*b*-1*d* show slidable element 102*a* in a closed position, partially opened position, and fully opened position respectively. After handle 425 is operated to reverse the expansion of the compression jamb, the slidable elements may slide towards the compression jamb to a position where they may be pivoted open. For example, when pulling handle 118 inwards, slidable element 102*a* pivots about its hinge axis. Pulling the handle and pivoting the slidable element 102*a* causes a free wheel assembly 106*a* exits the insert guide 104. As will be discussed elsewhere herein, the free wheel assembly 106 is used to movably support the slidable element 102 (in conjunction with upper hinge wheel assembly 108 and lower hinge wheel assembly 110) while the element is moved from side to side within the movable closure system 100. Normally a free wheel assembly is disposed within (i.e. hidden by) the upper rail 114. However, opening each element causes the free wheel assembly 106 to exit the upper rail 114 through the insert guide 104.

Figure 1E:
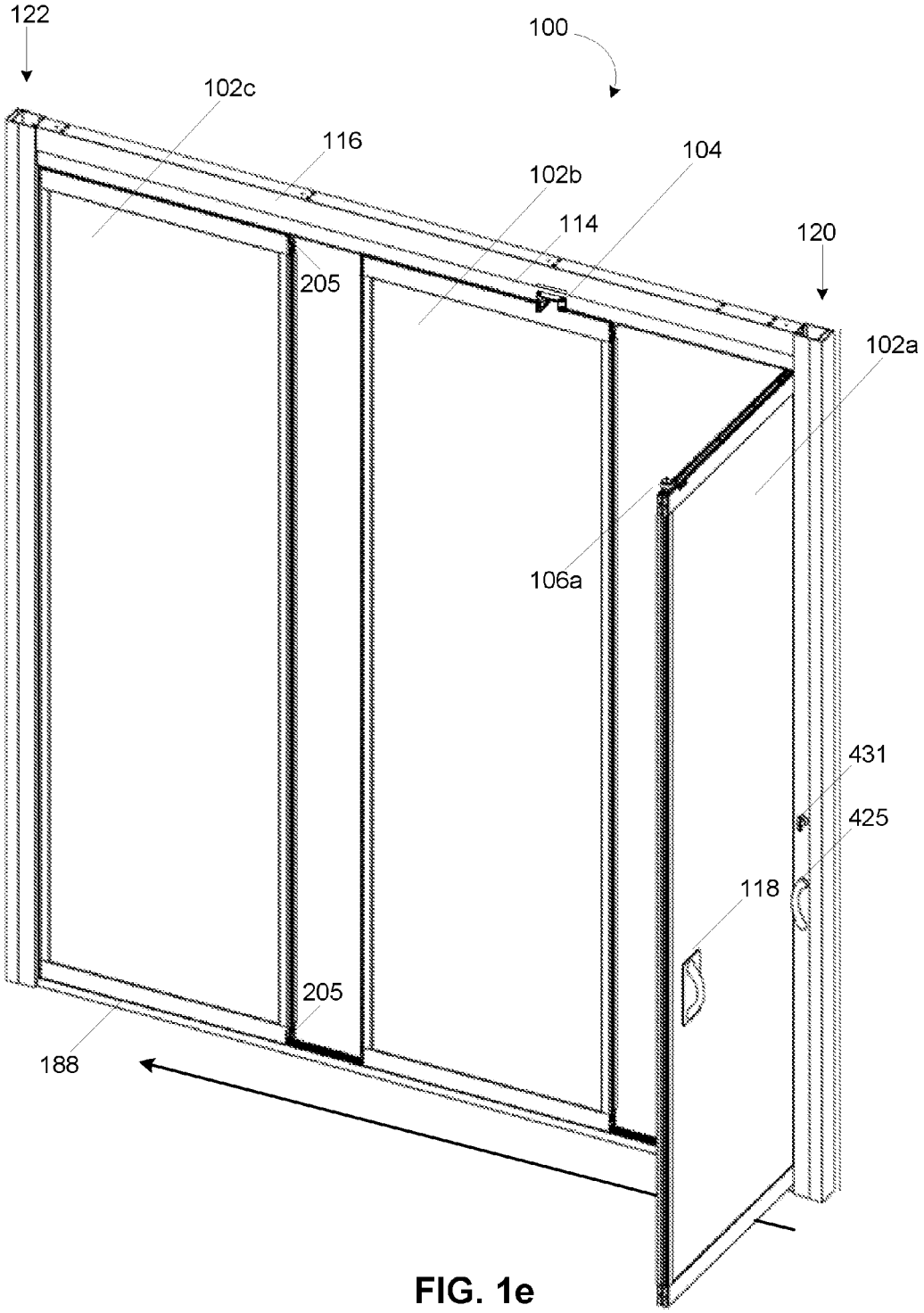
Figure 1F:
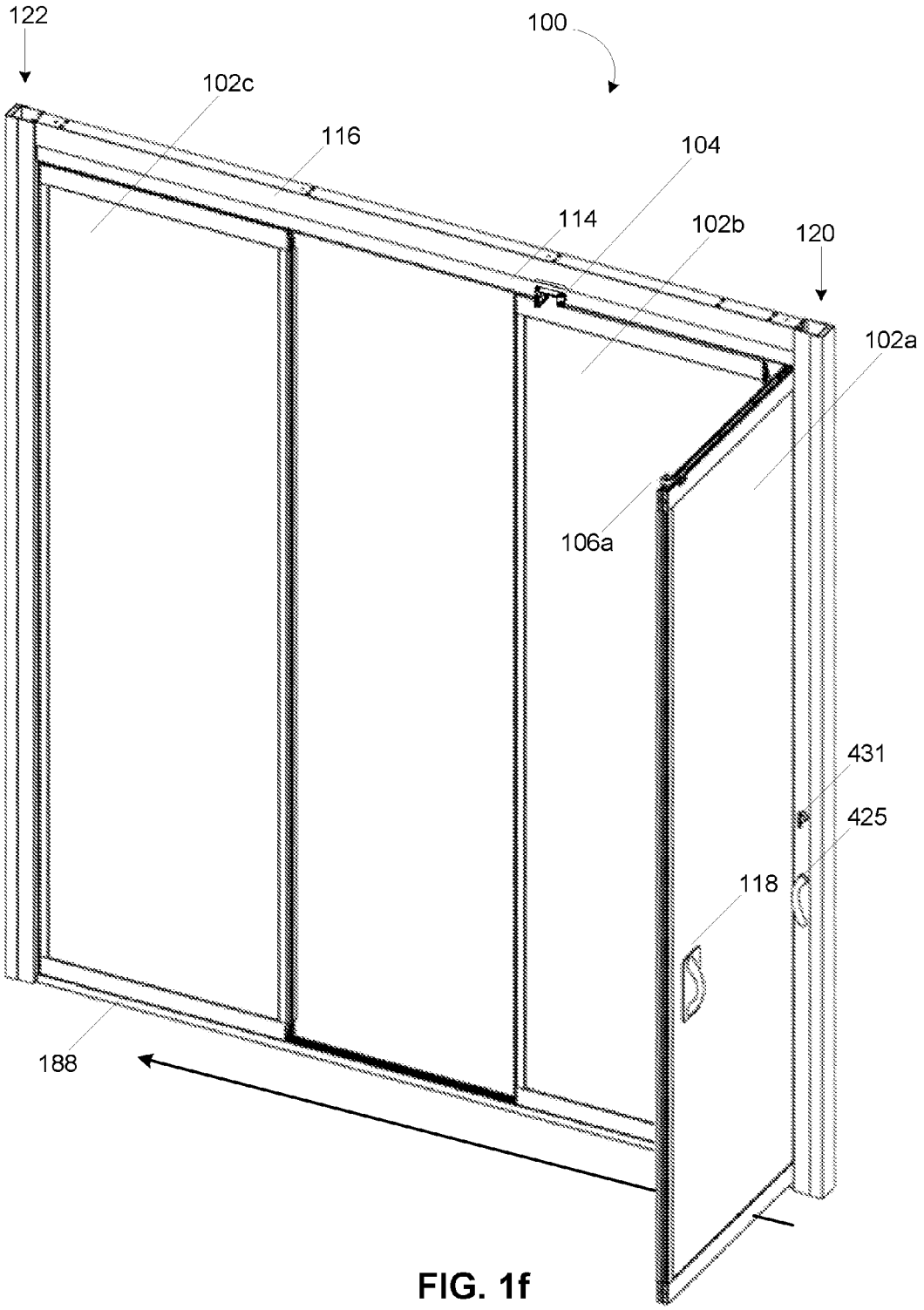
Figure 1G:
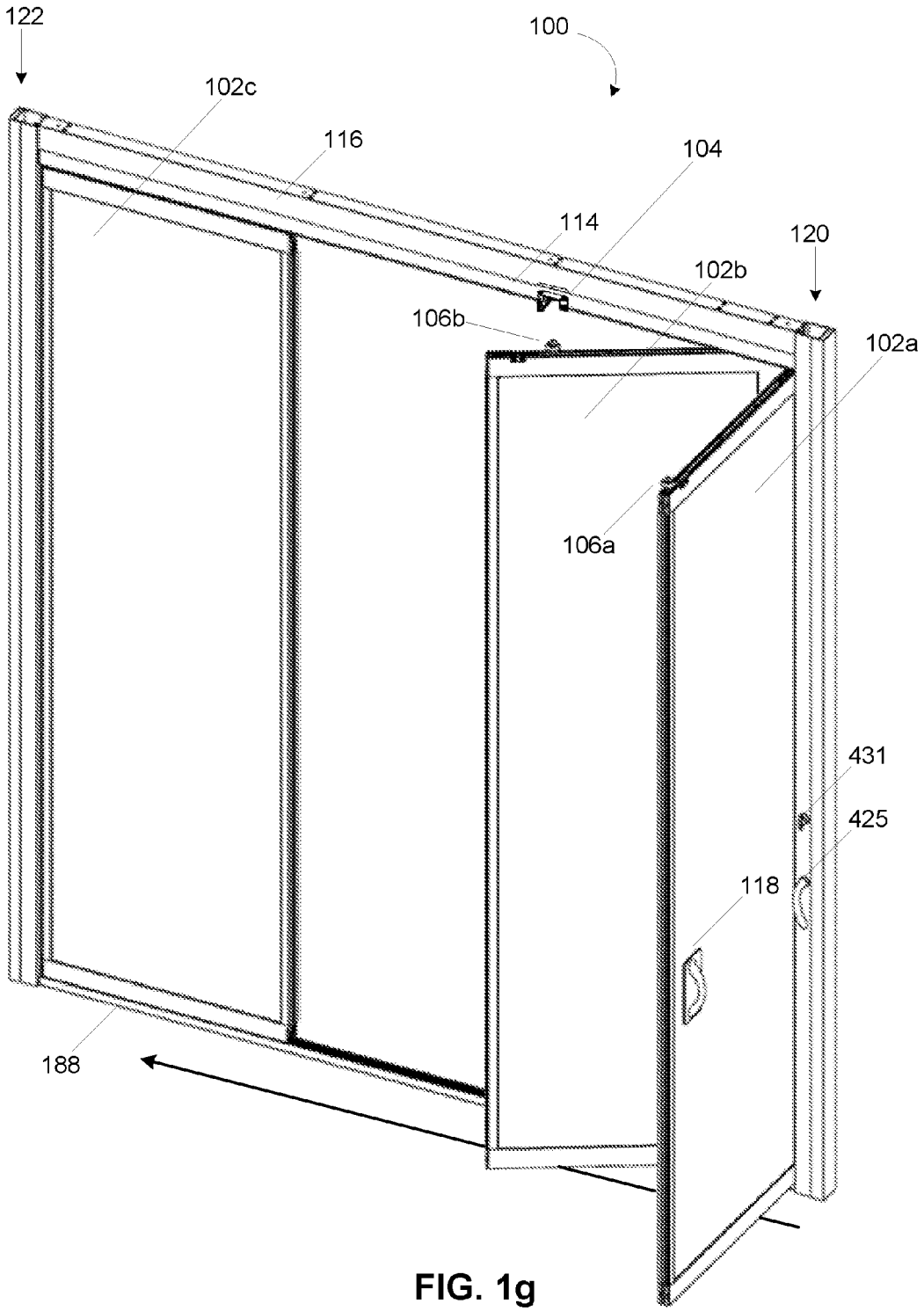
Figure 1H:
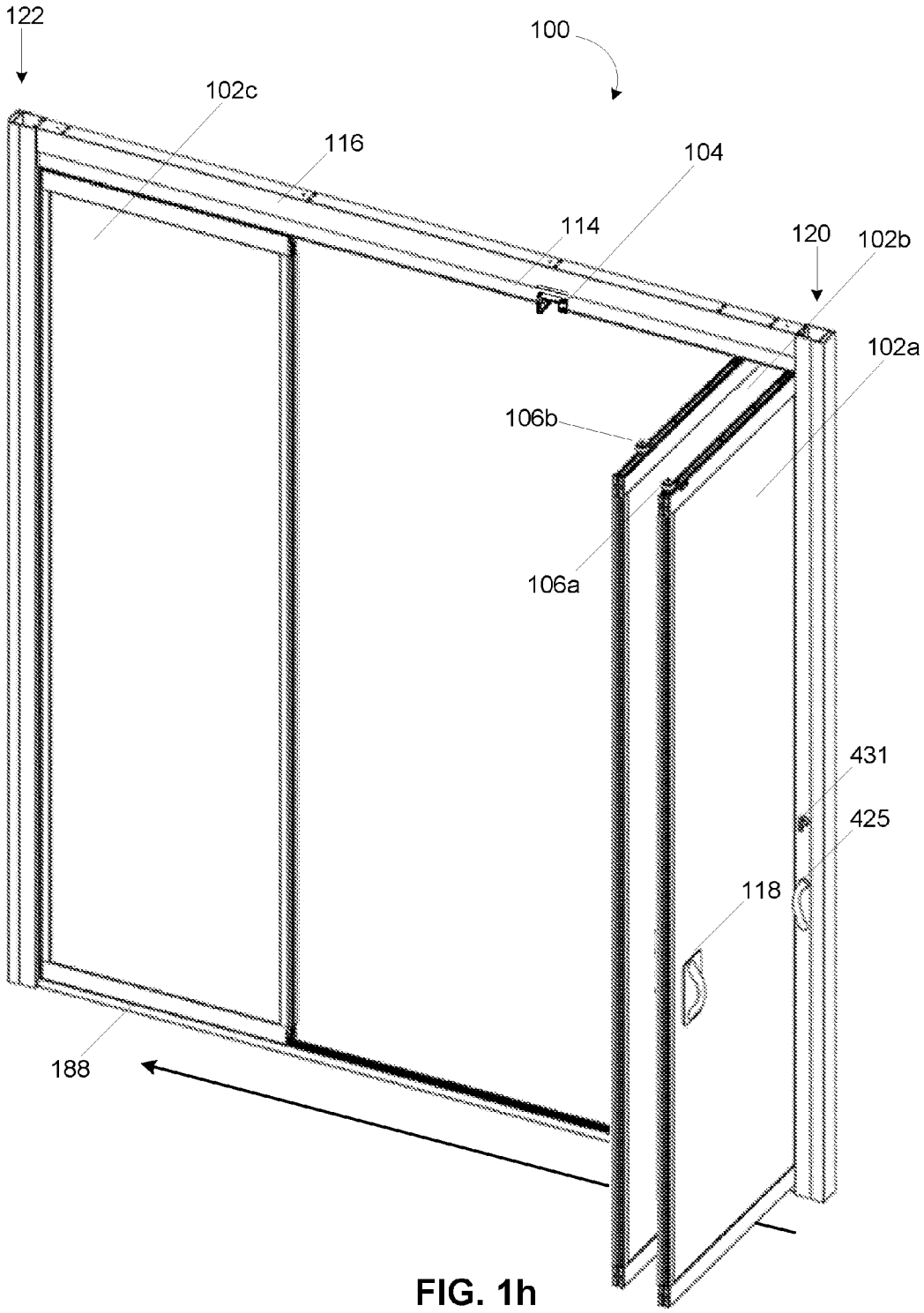

The next slidable element 102*b* may be opened by first sliding the element to the right into position from which it may be pivoted, as seen in FIGS. 1*e* and 1*f*. Upon reaching the opening position, the slidable element may be opened upon which a mechanism hingeably locks slidable element 102*b* into place about its hinge axis (i.e. so that the slidable element rotates about the hinge axis but cannot be moved laterally). The mechanism which locks the movable slidable elements into place is disclosed elsewhere herein. FIGS. 1*g* and 1*h* depict a partially opened and fully opened position respectively of slidable element 102*b*. As may be seen in FIG. 1*h*, opening successive slidable elements 102 creates a "stack" of pivoted, opened slidable elements at one end of the movable closure system 100, called the stacking end 120.

As seen in FIGS. 1*g* and 1*h*, free wheel assemblies 106*a* and 106*b* are at different distances from the front edge of their respective slidable elements 102*a* and 102*b* ("front edge" referring to the edge of the slidable element 102 facing the closure end 122 of the movable closure system 100, i.e. the edge of the slidable element 102 in the direction of the arrows). As will be made more clear elsewhere herein, each successive slidable element 102, when moved to its opening position within the movable closure system 100 (i.e. when its free wheel assembly 106 is positioned to exit the upper rail 114 at the insert guide 104), has a distance between the hinge axis for that slidable element 102 and the insert guide 104 smaller than for the previous slidable element 102. Accordingly, each successive element's free wheel assembly 106 is further from the front edge of the slidable element 102 on which it is disposed.

Figure 1I:
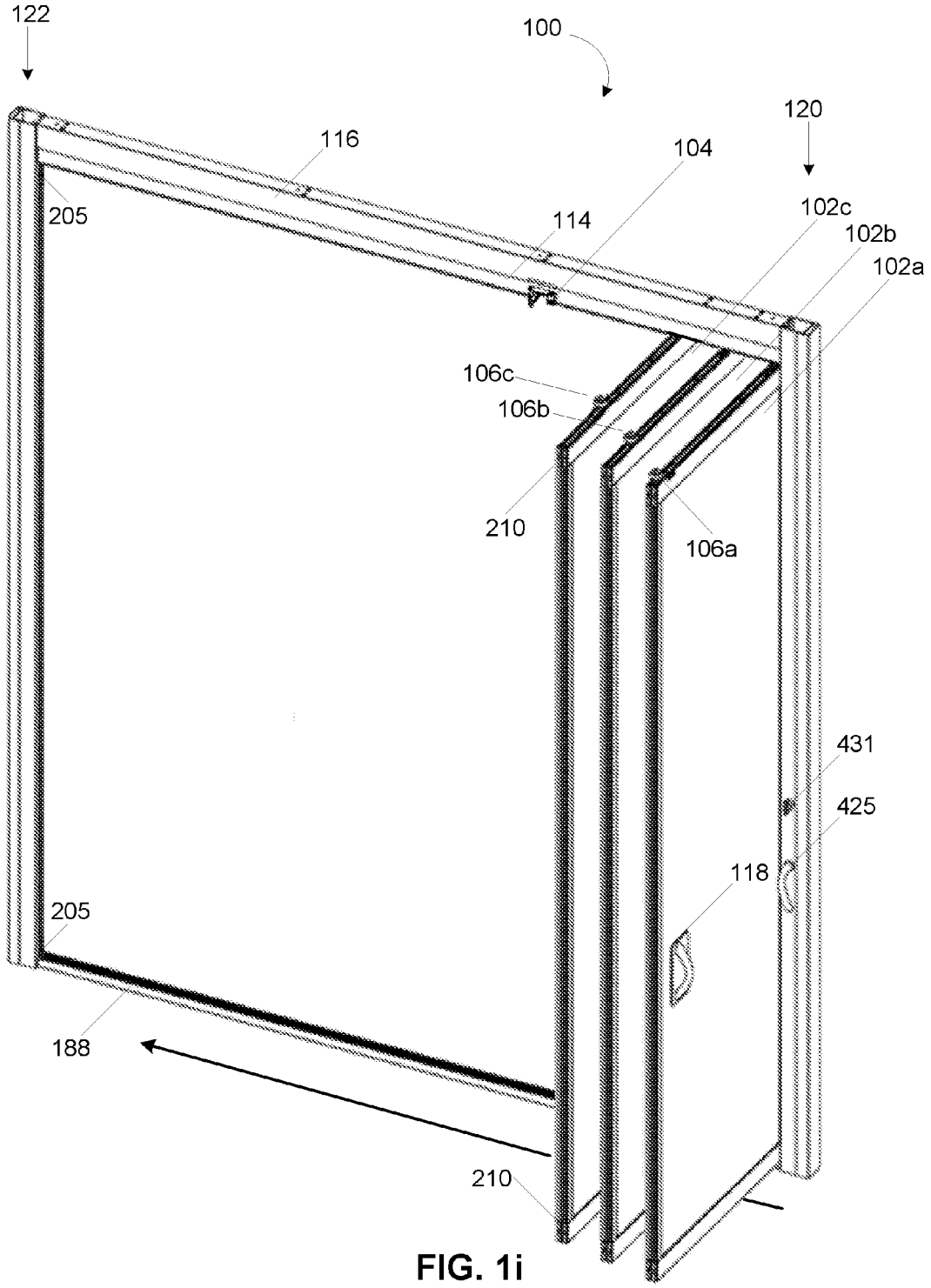
Figure 1J:
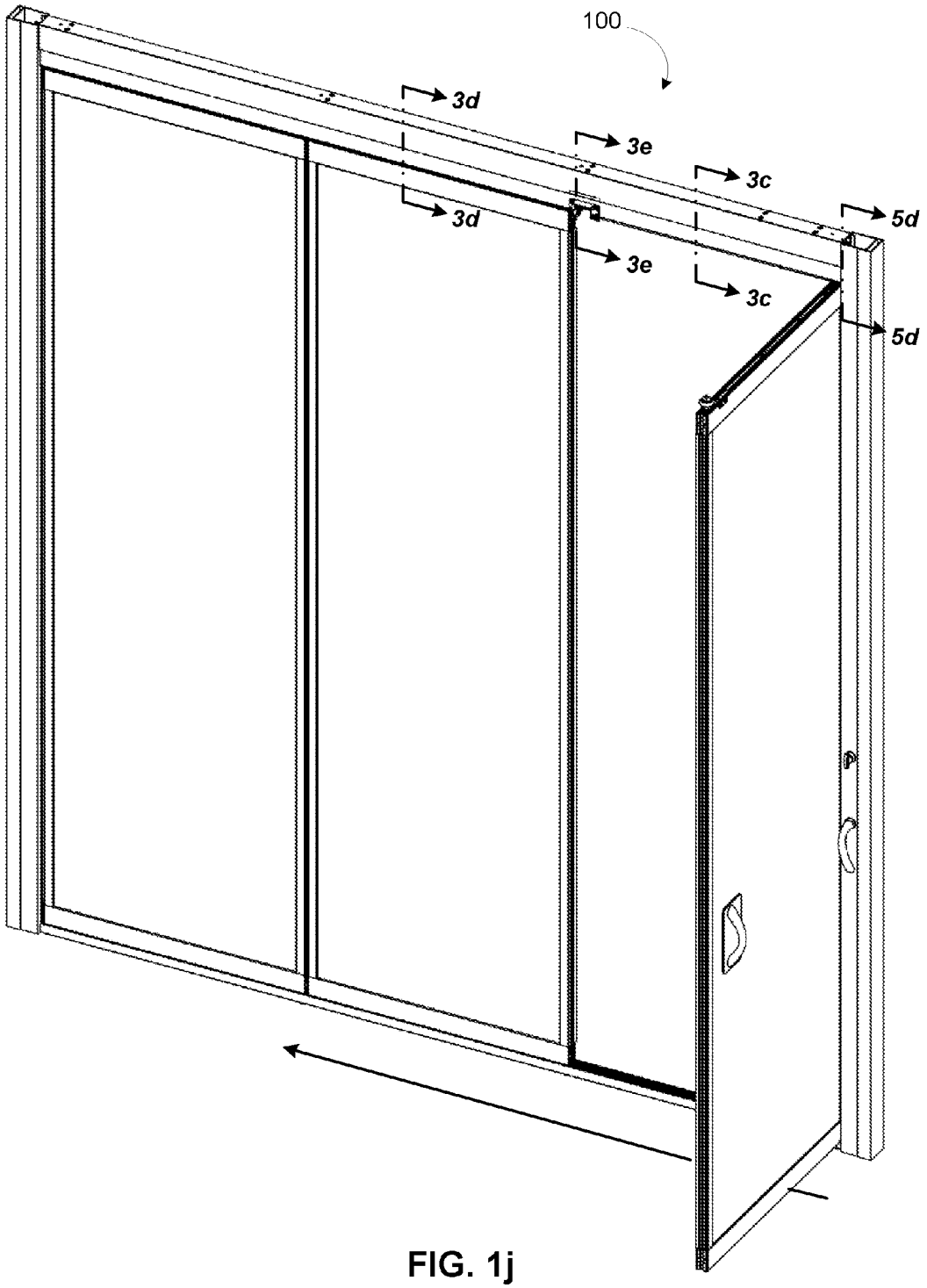

Continuing the narrative description of the operation of opening the movable closure system, slidable element 102*c* may also be opened by slidably moving it into its opening position. It may too be opened by pivoting it about its hinge axis, hingeably locking the element into place so that it only swivels and does not move from side to side, and adding slidable element 102*c* to the stack as may be seen in FIG. 1*i*. (Intermediate views between FIGS. 1*h* and 1*i* showing slidable element 102*c* sliding to the opening position and being partially opened, corresponding to FIGS. 1*e*-1*g* for slidable element 102*b*, are omitted.) While the movable closure system 100 depicted in the figures includes only three slidable elements 102, it is possible to have a larger-scale system with many more slidable elements as needed to fit a particular aperture through a structure.

Closing of the movable closure system 100 occurs in reverse of the opening operation. Each slidable element 102 is pivoted with its free wheel assembly 106 going through the insert guide 104 of the upper rail 114, the slidable element then being slid to the closure end 122 of the tracks, the closure end 122 being the end opposite the stacking end 120 of the tracks. Upon all slidable elements 102 being pivoted and slid away from the stacking end 120 of the movable closure system 100, the system may be closed through use of a compression jamb or other means.

Figure 2:
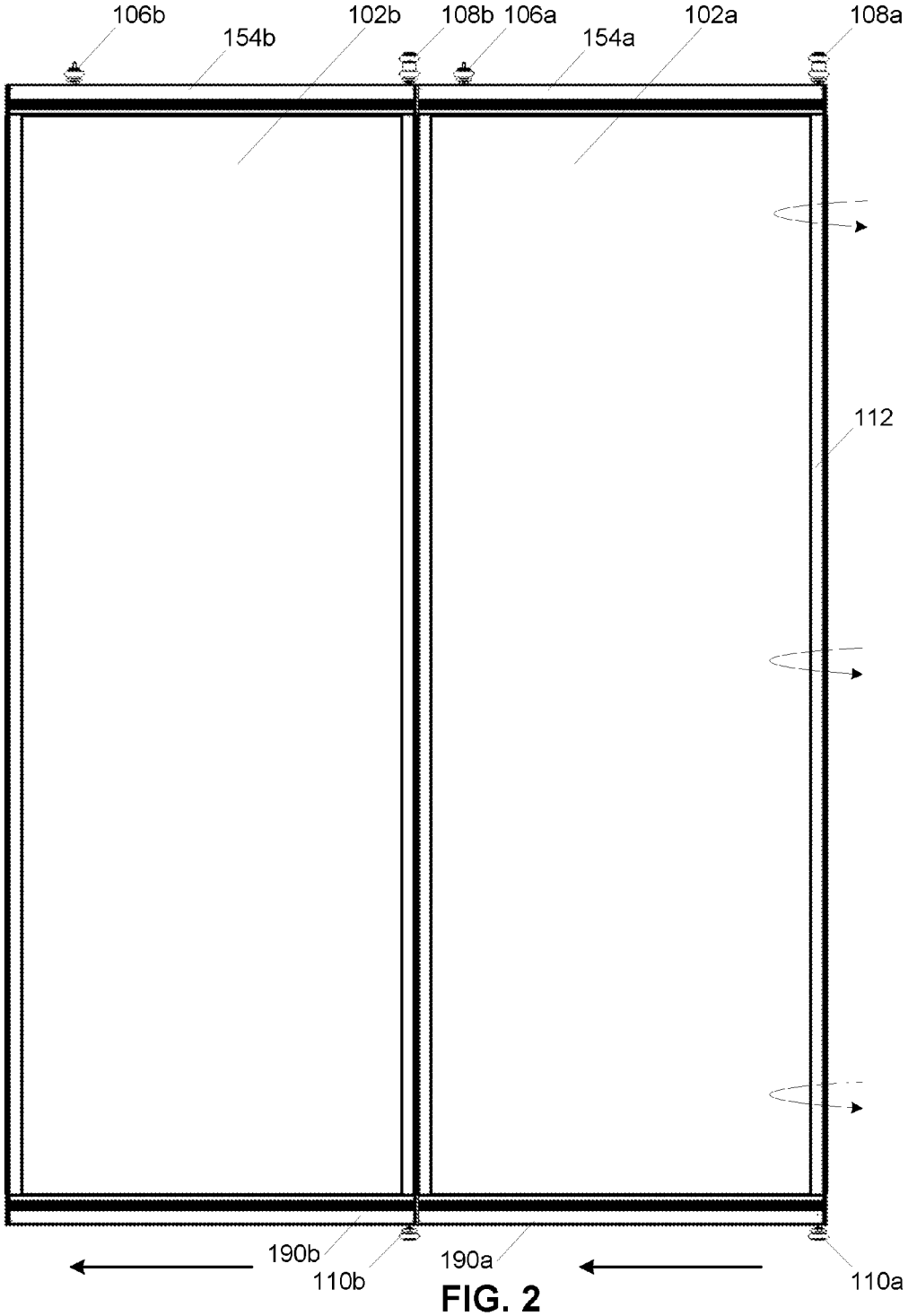
FIG. 2 is a front view of two adjacent slidable elements.

FIG. 2 is a front view of two adjacent slidable elements 102*a* and 102*b*, in accordance with an embodiment of the invention. With the upper rail not being present in FIG. 2, it may be seen that a slidable element may have two upper wheel assemblies 106 (free wheel assembly) and 108 (upper hinge wheel assembly), the upper wheel assemblies including horizontally-oriented wheels. The lower rail is also not present, so it may be seen that a slidable element may have one lower hinge wheel assembly 110 including horizontally-oriented wheels.

Horizontally-oriented wheels offer significant benefits. For example, horizontally-oriented wheels require less space vertically than vertically-oriented wheels. Accordingly, the adjustable upper and lower tracks may be shorter vertically while still accommodating the horizontally-oriented wheels. This enables the movable elements to have more vertical space for glass or other transparent material, providing a greater area of visibility through the slidable elements. Additionally, the lower track in which the lower hinge wheel assembly runs may have a top edge lower to the ground and/or the lower track may be lower profile and need a shallower trench in the ground by virtue of the horizontally-oriented wheels requiring less vertical space than vertical wheels. Horizontally-oriented wheels also facilitate movement of slidable elements about a curved track, or even around a 90-degree angle.

Further, the horizontally-oriented wheels have rounded edges, rather than being cylindrical in shape. The rounded edges mate with arcuate channels through the upper and lower tracks. In this manner, more significant portions of the wheels engage the channels through the tracks when compared to flat-edged wheels for improved support of the slidable elements. Additionally, the rounded-edged wheels facilitate entry of the wheels into an insert guide of the upper rail.

It may be seen from FIG. 2 that the lower hinge wheel assembly 110 is set directly below the upper hinge wheel assembly 108 such that a hinge axis 112 runs through and between the upper and lower hinge wheel assemblies. Hinge axis 112 runs through vertically-disposed wheel hub portions of the upper and lower hinge wheel assemblies, the vertically-disposed wheel hub portions forming axles about which the horizontally-oriented wheels rotate.

It may also be seen that the two upper wheel assemblies, portions of which extend into upper rail 114, may have different shapes. Particularly, the upper wheel assemblies may include free wheel assembly 106, shown as the free wheel assemblies 106*a* and 106*b* seen in FIG. 2 at the top left of slidable elements 102*a* and 102*b* respectively. The free wheel assembly 106 is disposed nearest the front edge of the slidable element. (The designation of the "front edge" refers to the direction of travel of the slidable elements 102 when closing the movable closure system 100.) The upper wheel assemblies may also include upper hinge wheel assembly 108, shown as the upper hinge wheel assemblies 108*a* and 108*b* seen in FIG. 2 at the top right of the slidable elements 102*a* and 102*b* respectively.

In some embodiments, an upper glazing profile 154 can be an object which is coupled to the top edge of a piece of glass or other panel. A lower glazing profile 190 can be an object which is coupled to the bottom edge of the piece of glass or other panel. The upper and lower glazing profiles run substantially from the left edge to the right edge (front edge to back edge) of the panel. Opposite the top edge of the panel is where an upper glazing profile would be inserted into and/or surround an adjustable upper track mounted in the top edge of the aperture. Opposite a bottom edge of the panel, a lower glazing profile is disposed into which the lower hinge wheel assembly engaging the adjustable lower track is be mounted. No vertical panels are required along the edges of the slidable element, other than the pane of glass or other material which makes up the majority of the slidable element, although in some embodiments vertical panels between the upper and lower glazing profiles are present on either edge of the main panel of each slidable element. Each glazing profile may have removable sides. One or more sex bolts (barrel bolts, e.g.) may be used to affix portions of a glazing profile to a glass panel of the slidable element. For manufacturing, distribution, and/or installation ease, different thickness panels are accommodated with using only a single set of glazing profiles, each set making up the two removable sides, and appropriately-sized bolts for the thickness of the panel. Weather-tight seals may be disposed between the tracks and glazing profiles. In some embodiments the seals may be H-shaped weatherstrips.

Support portions of the free wheel assembly 106 and upper hinge wheel assembly 108 are set within the upper glazing profile 154, which, as previously discussed, forms the top portion of the movable element and receives glass or other transparent material (or even materials that are less than transparent). The wheel portions of the free wheel and upper hinge wheel assemblies rise above the upper glazing profile in order to extend into the upper rail. As will be discussed below, the free wheel and upper hinge wheel assemblies are coupled with a pushrod running horizontally through the upper glazing profile.

Similarly, support portions of the lower hinge wheel assembly 110 are set within a lower glazing profile 190, which forms the bottom portion of the movable element for receiving glass or other transparent material. The wheel portions of the lower hinge wheel assembly descend below the lower glazing profile in order to extend into the lower rail.

When opening the movable closure system 100, each slidable element 102 rotates on hinge axis 112 between and through the upper hinge wheel assembly 108 and the lower hinge wheel assembly 110. Curved arrows in FIG. 2 show the direction in which the slidable elements 102 would rotate about the hinge axis 112 when each successive slidable element 102 is moved into alignment with the insert guide along the upper rail.

As described previously, opening the movable closure system 100 involves moving each slidable element 102 into a position where it may be pivoted about hinge axis 112 extending from the upper hinge wheel assembly 108 to the lower hinge wheel assembly 110, and where the hinge axis 112 is correctly aligned with a corresponding locator hole for the slidable element through a hinge block disposed within the upper rail. Opening further includes pivoting the slidable element 102 about the hinge axis 112 until it is approximately perpendicular to top and lower tracks of the movable closure system 100 (the tracks not visible in FIG. 2, but visible in FIGS. 1*a*-1*i*). As seen in FIG. 1*i*, pivoting subsequent slidable elements 102 forms a "stack" of opened slidable elements 102, stacked at a substantially 90 degree angle to the upper and lower tracks of the system movable closure system 100. In this way, multiple slidable elements 102 may be rotated and "stacked" near the stacking end 120 of the aperture through the structure in which the movable closure system 100 is deployed.

Upon the slidable element 102 being pivoted, it is held in place within the movable closure system 100 only with portions of the upper hinge wheel assembly 108 and the lower hinge wheel assembly 110, which are the wheel assemblies disposed adjacent to the "back edge" of the slidable element 102 (the "back edge" referring to the edge of the slidable element 102 opposite to the direction of the arrows and opposite the "front edge" of the slidable element 102, i.e. the back edge is closest to the stacking end). The weight of the slidable element 102 then exerts substantial pressure on the upper hinge wheel assembly 108 and its engagement with the upper rail and hinge block. Without the support of the upper hinge wheel assembly 108 in the upper rail and hinge the slidable element would have a tendency to fall away from the upper track under its own weight. Consequently, sturdy, durable hinge wheel assemblies and locking mechanisms described elsewhere herein are used to withstand the tendency of the slidable element 102 to fall away from the upper track under its own weight.

Figure 3A:
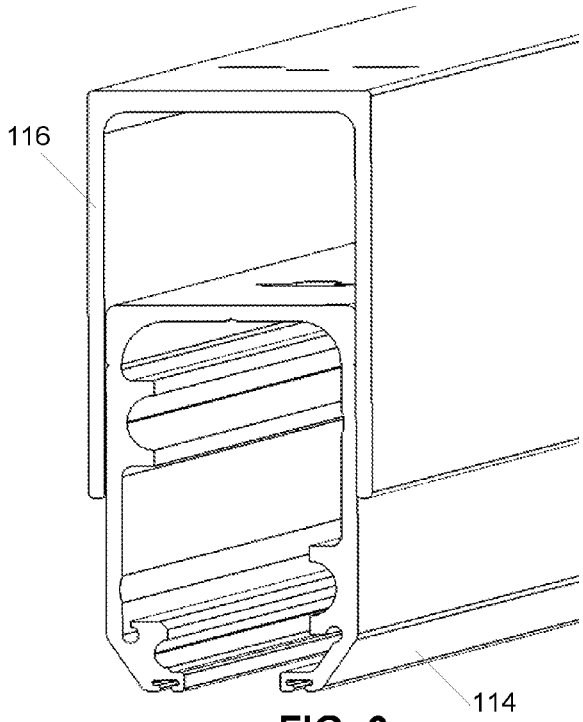
FIGS. 3*a* and 3*b* are a perspective view of a back edge and an exploded view of an adjustable upper track of the movable closure system.
Figure 3B:
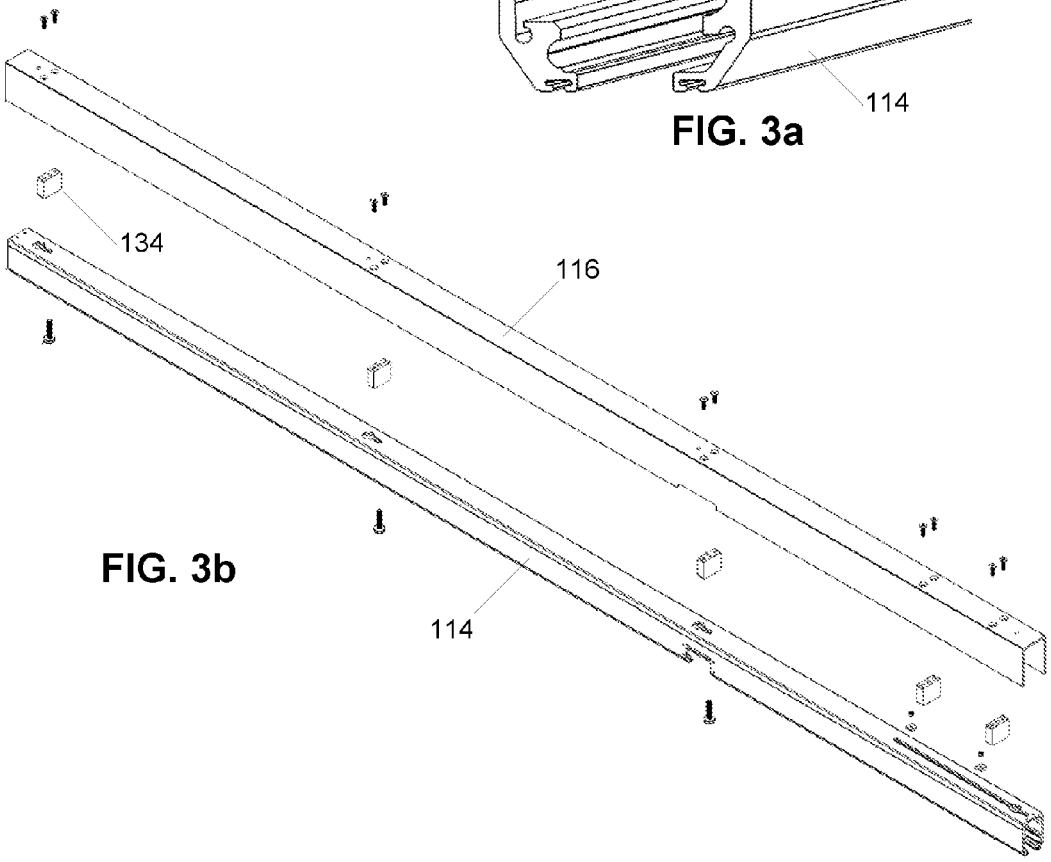

FIGS. 3*a* and 3*b* are a perspective view of a back edge and an exploded view of an adjustable upper track of the movable closure system 100, in accordance with an embodiment of the invention. In some embodiments, an adjustable upper track may be divided into a C-channel 116 and an upper rail 114. One or more adjustment blocks 134 may be disposed between the C-channel and the upper rail. The adjustment blocks can vary in height so that the vertical distance between the C-channel and upper rail may vary. The C-channel and upper rail are coupled via fasteners threaded through the C-channel, adjustment blocks, and the upper rail, with the adjustment blocks sized to ensure the top rail from which the slidable elements hang is level, even if the C-channel attached to the structure is not.

The upper rail provides a pathway through which the free wheel assembly 106 and the upper hinge wheel assembly 108 (in conjunction with the bottom wheel assembly 110) movably support the slidable element 102 while the element is moved from side to side within the movable closure system 100. As will be discussed below, portions of the upper rail support and/or engage horizontal wheels of the free wheel assembly and upper hinge wheel assembly.

Figure 3C:
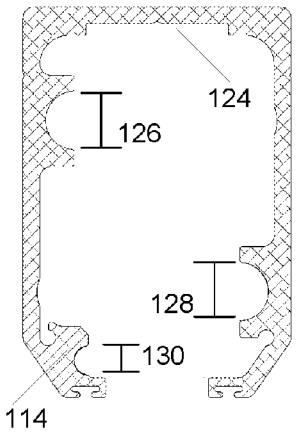
FIG. 3*c* is a side cross-sectional view of the upper rail.
Figure 3D:
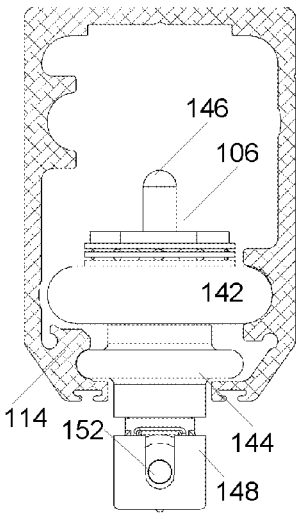
FIG. 3*d* is a side cross-sectional view of the upper rail with a free wheel assembly in view.
Figure 3E:
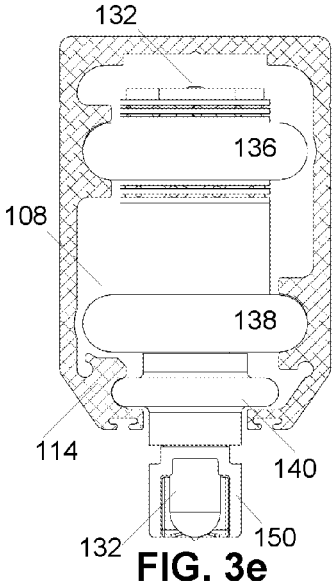
FIG. 3*e* is a side cross-sectional view of the upper rail with an upper hinge wheel assembly in view.
Figure 3F:
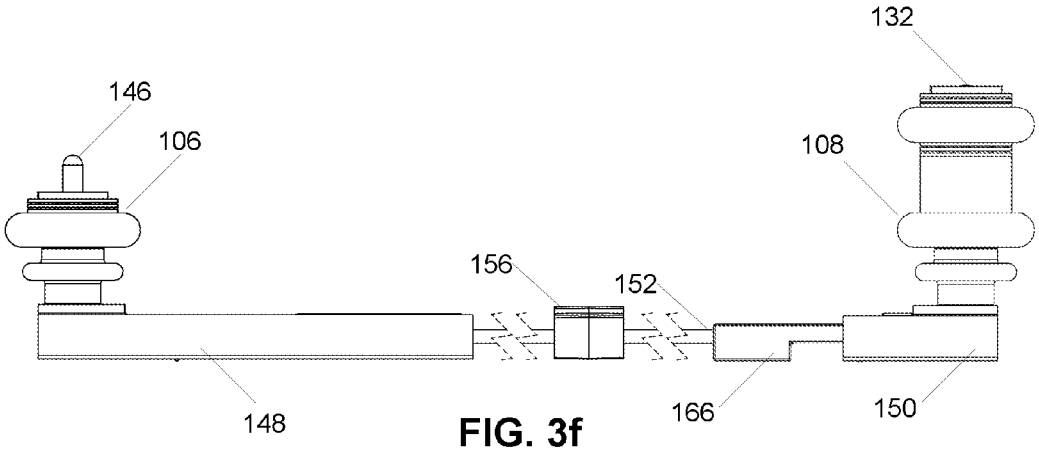
FIG. 3*f* is a front view of the free wheel and upper hinge wheel assemblies coupled with a pushrod.

FIG. 3*c* is a side cross-sectional view of the upper rail 114, in accordance with an embodiment of the invention. FIG. 3*d* is a side cross-sectional view of the upper rail 114 with free wheel assembly 106 in view, in accordance with an embodiment of the invention. FIG. 3*e* is a side cross-sectional view of the upper rail 114 with upper hinge wheel assembly 108 in view, in accordance with an embodiment of the invention. FIG. 3*f* is a front view of the free wheel and upper hinge wheel assemblies coupled with a pushrod, in accordance with an embodiment of the invention. FIGS. 3*g* and 3*h* are a perspective view and an exploded perspective view of the free wheel assembly, in accordance with an embodiment of the invention. FIGS. 3*i* and 3*j* are a perspective view and an exploded perspective view of the upper hinge wheel assembly, in accordance with an embodiment of the invention. FIG. 3*k* is an exploded view of a clicker subassembly of the free wheel assembly, in accordance with an embodiment of the invention.

As previously disclosed, the free wheel assembly and upper hinge wheel assembly run within ("movably support") the upper rail when the slidable elements are moved from side to side. In some embodiments, horizontal channels for receiving wheel portions of the free and upper hinge wheel assemblies are disposed from end to end of the upper rail 114. As best seen in FIGS. 3*c*, 3*d*, and 3*e*, the horizontal channels have arcuate portions configured for receiving the horizontal wheels of the top wheel assembly 106 and the upper hinge wheel assembly 108.

Particularly, an upper rail may include the following arcuate portions: an upper load wheel channel 126, a lower load wheel channel 128, and an idler wheel channel 130. The upper load wheel channel is configured for receiving an upper load wheel 136 of the upper hinge wheel assembly 108. The lower load wheel channel is configured for receiving a lower load wheel 138 of the upper hinge wheel assembly and for receiving a lower load wheel 142 of the free wheel assembly 106. The idler wheel channel is configured for receiving an idler wheel 140 of the upper hinge wheel assembly and for receiving an idler wheel 144 of the free wheel assembly. It will be noted that the upper load wheel channel is traversed only by an upper load wheel of upper hinge wheel assemblies. The free wheel assemblies do not have an upper load wheel, only a lower load wheel and idler wheel.

Also visible in FIGS. 3*c* through 3*e* is a hinge block recess 124. The hinge block recess is configured for receiving a hinge block.

FIGS. 3*d*, 3*e*, and 3*f* depict the wheel assemblies as they would appear when the movable elements are not in the opened position (i.e. as they would appear when the movable elements are not swung open about the hinge axis). It will be observed that, when the movable elements are not in the opened position, the free wheel assembly 106 has a button 146 disposed through its rotational axis, the button shown in FIGS. 3*d* and 3*f* in a raised position. Additionally, the upper hinge wheel assembly 108 has a locator pin 132 disposed through its rotational axis, the locator pin shown in FIGS. 3*e* and 3*f* in a lowered position. (The full length of the button 146 and locator pin 132 may be seen in FIGS. 3*h* and 3*j* with exploded views of the free wheel assembly 106 and upper hinge wheel assembly 108, respectively.)

The raised and lowered positions of the button 146 and locator pin 132 are partially driven by compression springs internal to the free wheel assembly 106 and upper hinge wheel assembly 108 respectively. The free wheel assembly and upper hinge wheel assembly are configured via the compression spring for biasing the button and locator pin into a lower position. For example, in FIG. 3*h* it may be seen that the free wheel assembly compression spring 162 rests on top of a collar portion of button 146 and abuts a bottom portion of the free wheel assembly wheel hub 148, the free wheel assembly compression spring having a tendency to push the button down and away from the free wheel assembly wheel hub. Likewise, in FIG. 3*j* it may be seen that the upper hinge wheel assembly compression spring 164 rests on top of a collar portion of locator pin 132 and abuts a bottom portion of the upper hinge wheel assembly wheel hub 150, the upper hinge wheel assembly compression spring having a tendency to push the locator pin down and away from the upper hinge wheel assembly wheel hub.

As seen in FIG. 3*f*, to drive the up and down action of the button and locator pin, the free wheel assembly 106 and upper hinge wheel assembly 108 are in physical communication via a pushrod 152, which is disposed within a horizontal cavity across the top of an upper glazing profile 154 of the movable elements. (See FIGS. 5*a* and 5*b*.) The pushrod may be supported within the upper glazing profile by one or more pushrod standoffs 156, the pushrod standoffs mounted inside the horizontal top cavity of the upper glazing profile and through which the pushrod may be disposed. As a consequence of the distance between the upper hinge wheel assembly and free wheel assembly becoming shorter with each successive movable element from back to front (discussed above with respect to FIGS. 1*g* and 1*h*), the pushrod for each movable element is commensurately shorter from back to front.

The pushrod 152 moves from side to side between the free wheel assembly 106 and upper hinge wheel assembly 108. At each end of the pushrod, it is inserted into the wheel assemblies. For example, FIGS. 3*g* and 3*h* show that the free wheel assembly wheel hub 148 has an aperture at one end for receiving an end of the pushrod 152. Within the free wheel assembly is a clicker 168 and a free wheel assembly actuator 160, the free wheel assembly actuator having a sloped surface that resembles a ramp. When the pushrod is driven into the free wheel assembly, it pushes against the clicker which in turn pushes against the free wheel assembly actuator. The sloped surface of the free wheel assembly actuator pushes against the bottom of the button 146, driving the button upwards into the raised position and compressing the free wheel assembly compression spring 162. When pushrod tension is released, the free wheel assembly compression spring pushes against the free wheel assembly wheel hub and the button to drive the button down and away from the free wheel assembly wheel hub.

Likewise, FIGS. 3*i* and 3*j* show that the upper hinge wheel assembly wheel hub 150 has an aperture at one end for receiving the upper hinge wheel assembly actuator 166, which in turn receives a portion of the pushrod 152 opposite to the pushrod end in contact with the free wheel assembly. The upper hinge wheel assembly actuator also has a sloped surface that resembles a ramp. When the pushrod is driven into the upper hinge wheel assembly, it pushes against the upper hinge wheel assembly actuator. The sloped surface of the upper hinge wheel assembly actuator pushes against the bottom of the locator pin 132, driving the locator pin upwards into the raised position and compressing the upper hinge wheel assembly compression spring 164. When pushrod tension is released, the upper hinge wheel assembly compression spring pushes against the upper hinge wheel assembly wheel hub and the locator pin to drive the locator pin down and away from the upper hinge wheel assembly wheel hub.

Accordingly it may be seen that when the pushrod is operated, the button and locator pins move in tandem. The button is raised when the locator pin is lowered, and the button is lowered when the locator pin is raised. Particularly, when the button of the free wheel assembly is in the raised position and the button is pushed down at its top, the bottom of the button pushes against the free wheel assembly actuator, which pushes against the clicker, which pushes against the pushrod, which pushes against the upper hinge wheel assembly actuator, which pushes the bottom of the locator pin causing the locator pin to move to the raised position. It will be seen that as a movable element is swung open about its hinge axis, the button is pushed down, engaging the pushrod and raising the locator pin of the upper hinge wheel assembly, which finds a hole in the hinge block for hingeably locking the movable element into place.

Figures 4A, 4B:
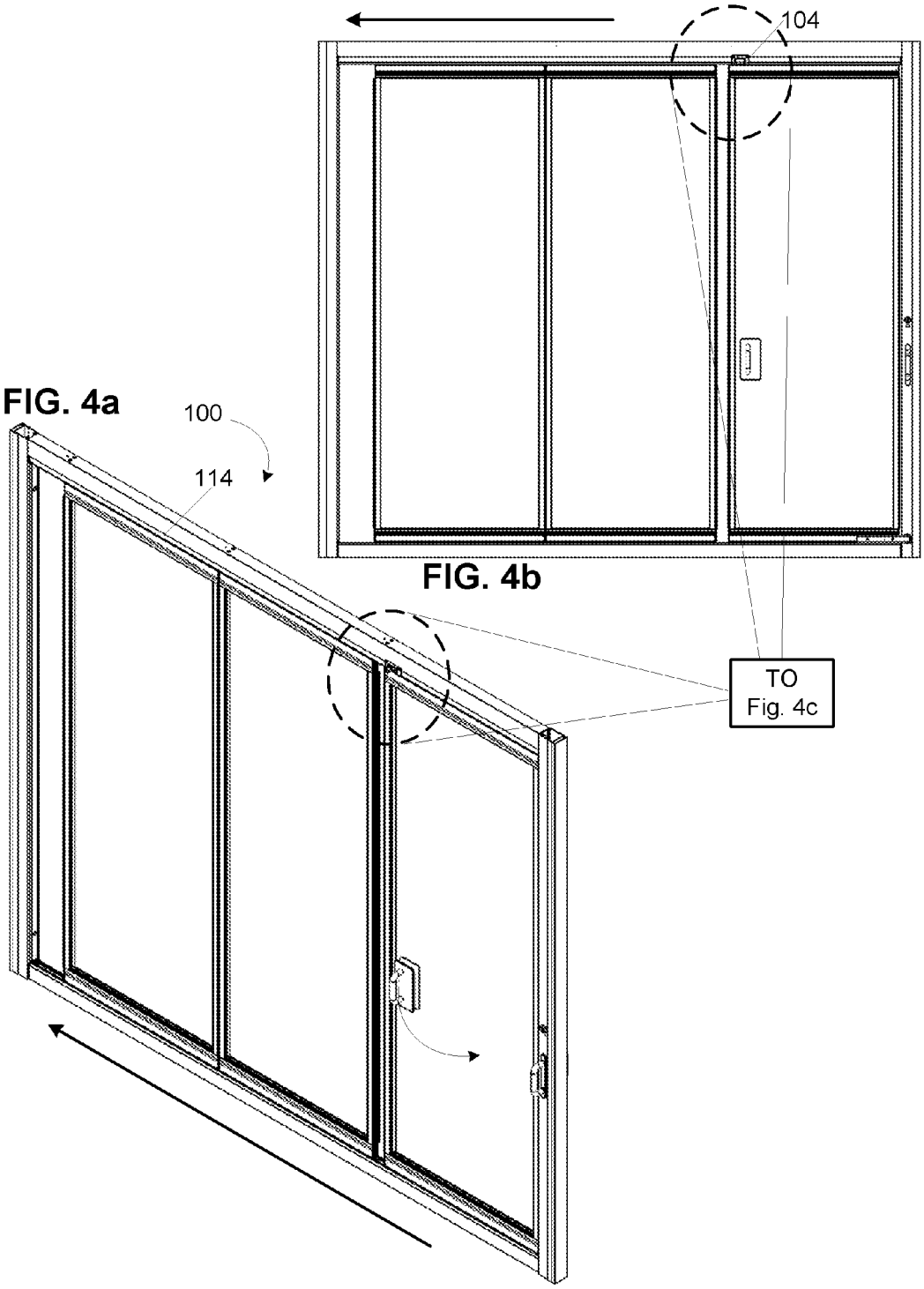
FIGS. 4*a* and 4*b* are a perspective view and a front view of a movable closure system.
Figure 4C:
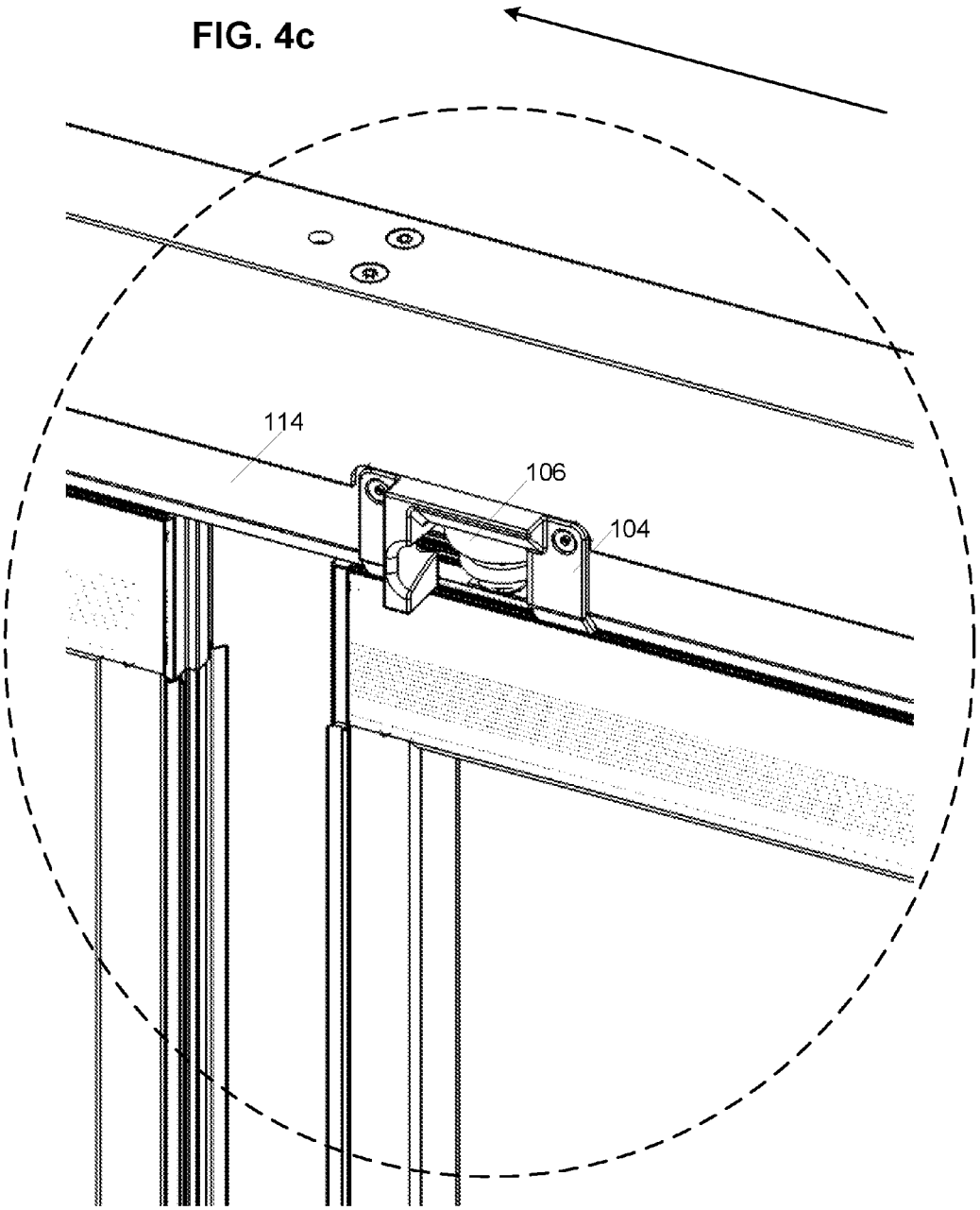
FIG. 4*c* is a close-up perspective view of an insert guide of the upper track of the movable closure system.
Figure 4D:
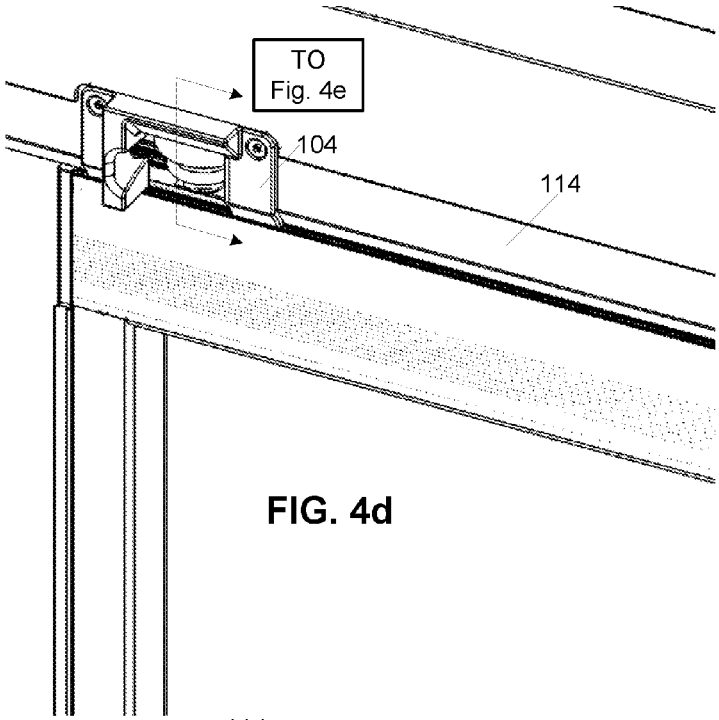
FIG. 4*d* is an additional perspective view of the insert guide of the upper rail, with a dashed line and arrows showing a bi-section location along the upper rail.
Figure 4G:
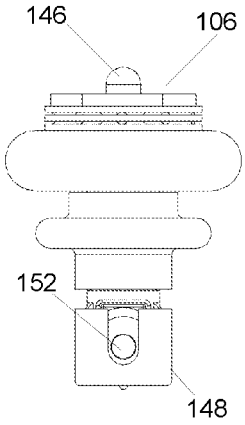
FIG. 4*g* is a side view of the free wheel assembly as it would appear when the slidable element of which the free wheel assembly is a part has been opened.
Figure 4E:
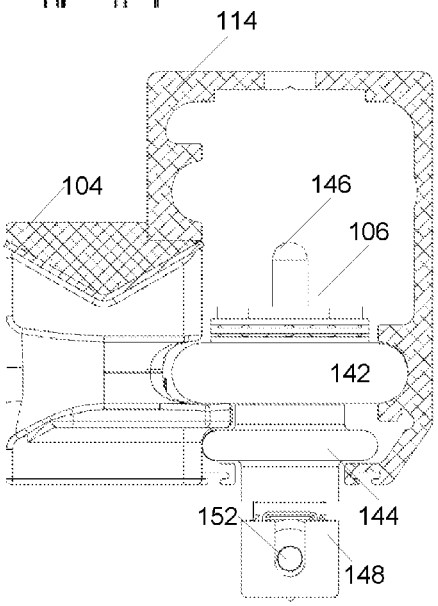
FIG. 4*e* is a cross-sectional view of the upper rail and insert guide at the bi-section location indicated by the dashed line and arrows, with the free wheel assembly visible.
Figure 4F:
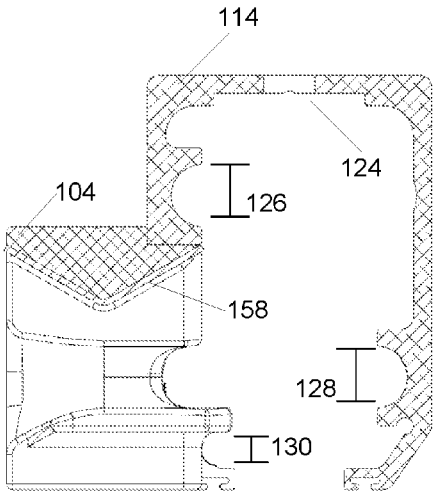
FIG. 4*f* is a cross-sectional view of the upper rail and insert guide at the same bi-section location, but without the free wheel assembly present.

FIGS. 4*a* and 4*b* are a perspective view and a front view of a movable closure system 100, with a portion shown in a dashed circle. That portion is enlarged in FIG. 4*c*, which is a close-up perspective view of an insert guide 104 of the upper rail 114 of the movable closure system 100, in accordance with an embodiment of the invention. A portion of a free wheel assembly 106 is visible through the insert guide. FIG. 4*d* is an additional perspective view of the insert guide 104 of the upper rail 114, with a dashed line and arrows showing a bi-section location along the upper rail. FIG. 4*e* is a cross-sectional view of the upper rail 114 and insert guide 104 at the bi-section location indicated by the dashed line and arrows, with the free wheel assembly 106 visible. FIG. 4*f* is a cross-sectional view of the upper rail 114 and insert guide 104 at the same bi-section location, but without the free wheel assembly present. FIG. 4*g* is a side view of the free wheel assembly as it would appear when the slidable element of which the free wheel assembly is a part has been opened.

A slidable element 102 slides along the track until the free wheel assembly 106 is aligned with the insert guide 104. When the free wheel assembly is aligned with the insert guide, the slidable element is in position for being opened. Upon pulling the handle (where slidable elements have mounted handles) or pulling the edge of the slidable element adjacent to the free wheel assembly, the slidable element pivots about the axis through the upper hinge wheel assembly and the lower hinge wheel assembly (as shown in FIG. 2). The free wheel assembly comes out of the track through the insert guide upon the slidable element being pivoted. In comparing FIG. 4*f* (showing the cross-sectional view of the upper rail at the bi-section location of the insert guide) with FIG. 3*c*, it may be seen that the lower load wheel channel 128 and the idler wheel channel 130 have apertures through the upper rail at the insert guide 104. The foregoing apertures enable the lower load wheel 142 and idler wheel 144 of the free wheel assembly 106 to exit the upper rail upon the slidable element being swung open.

In contrast, it will be noted that the upper load wheel channel 126 has no aperture through the insert guide, or at any point along the upper rail. It will also be noted that the free wheel assembly does not have an upper load wheel. As may be seen in FIG. 3*e*, only the upper hinge wheel assembly 108 has an upper load wheel 136 traversing the upper load wheel channel. The upper hinge wheel assembly's upper load wheel, which runs through the enclosed upper load wheel channel, ensures that a slidable element does not exit the system when the upper hinge wheel assembly is aligned with the insert guide. If an attempt to open the slidable element occurs when the upper hinge wheel assembly was aligned with the insert guide, the upper load wheel channel of the upper rail would retain the upper load wheel of the upper hinge wheel assembly, preventing the slidable element from rotating.

It may therefore be seen that a slidable element is only rotatable about its hinge axis when the slidable element has been slid to a position where the free wheel assembly is aligned with the insert guide, because the insert guide has only an aperture for a lower load wheel and not the upper load wheel of the upper hinge wheel assembly. In addition, as noted above, when the slidable element is opened the weight of the slidable element exerts substantial pressure on the upper hinge wheel assembly and its engagement with the upper rail, so the upper load wheel also provides extra support in tandem with the upper hinge wheel assembly's lower load wheel when the slidable element is in the open position.

It will be noted that insert guide 104 has a ramped surface 158 (referenced by number in FIG. 4*f* and visible in FIGS. 4*d* and 4*e*). It will additionally be noted that button 146 is in a raised position in FIG. 4*e*. When the slidable element 102 is pulled open, the rounded top portion of the button 146 is engaged by the ramped surface 158 of the insert guide 104. The action of opening the slidable element pushes the button down via the engagement of the button with the ramped surface. FIG. 4*g* depicts the free wheel assembly upon exiting the insert guide (i.e. with the button in the lower position). As previously discussed with reference to FIGS. 3*c*-3*j*, the button is in communication with the pushrod 152 such that opening a slidable element engages the pushrod, which in turn causes the locator pin to be driven upward to engage a mating locator hole in the hinge block. In addition, the clicker mechanism 168 visible in FIG. 3*h* is inline with the actuator blocks of the upper wheel assemblies and pushrod. The clicker includes a cam and spring arrangement which rotates to a locking position upon the engagement of the pushrod by the button. The locking position of the clicker ensures that the pushrod does not move in the opposite direction permitting the locator pin to drop while the slidable element is open.

When closing a slidable element (i.e. pivoting it back into place such that the element is disposed underneath the top rail), the insert guide receives the free wheel assembly. It may be seen that the insert guide has an arcuate edge on the left side for receiving the rounded edge of the load wheel of the free wheel assembly. The insert guide has an additional arcuate edge for receiving the rounded edge of the idler wheel of the free wheel assembly. Further, as the slidable element is closed and the free wheel assembly is received by the insert guide, the top of the button 146 passes underneath and presses against the lowest point of ramped surface 158 of the insert guide. The button is thereby pressed downward just enough to trip the clicker mechanism and unlock the pushrod mechanism. The compression spring of the upper hinge wheel assembly expands. The expansion of the upper hinge wheel assembly's compression spring causes the locator pin to drop down out of the hinge block. The bottom of the locator pin is pressed by the compression spring against the upper hinge wheel assembly actuator. Motion is thereby transferred via the upper wheel assemblies' actuators, the clicker and the pushrod to drive the button back to the raised position. The slidable element may then be slid towards the front edge of the movable closure system as desired.

Figure 5A:
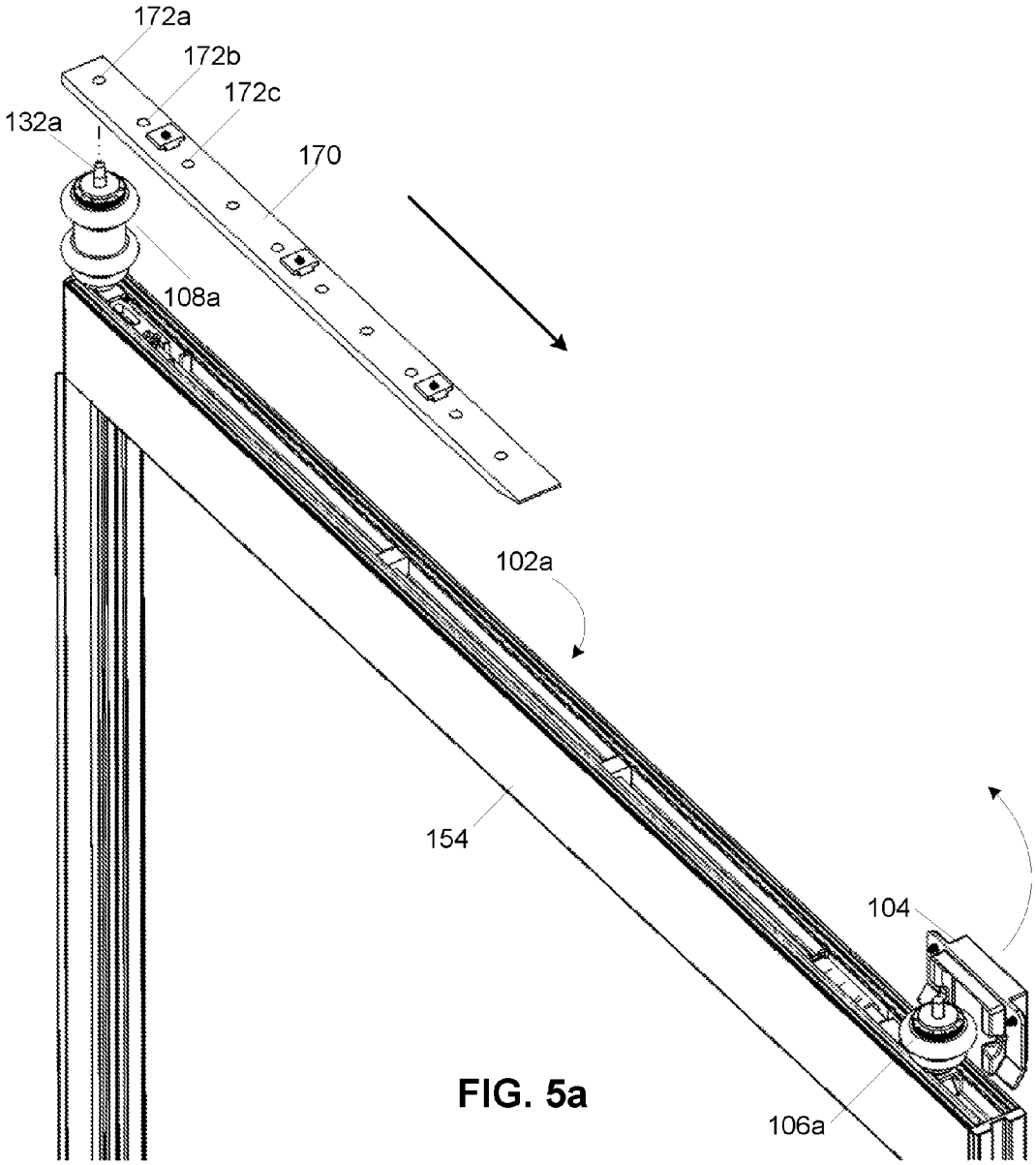
FIG. 5*a* is a perspective view of a top portion of a slidable element underneath a hinge block, as viewed from the back of the system.
Figure 5B:
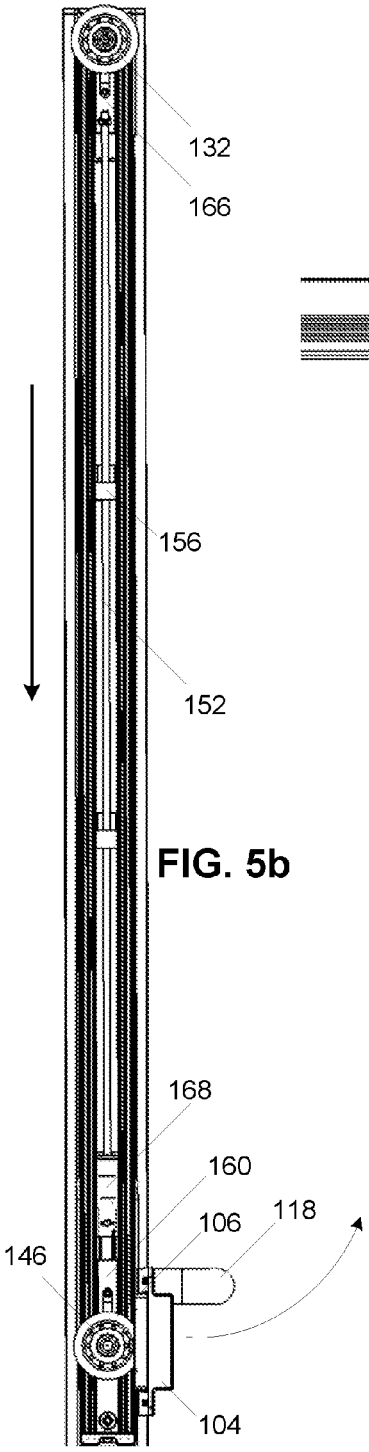
FIG. 5*b* is a top view of the top portion of the slidable element.
Figure 5C:
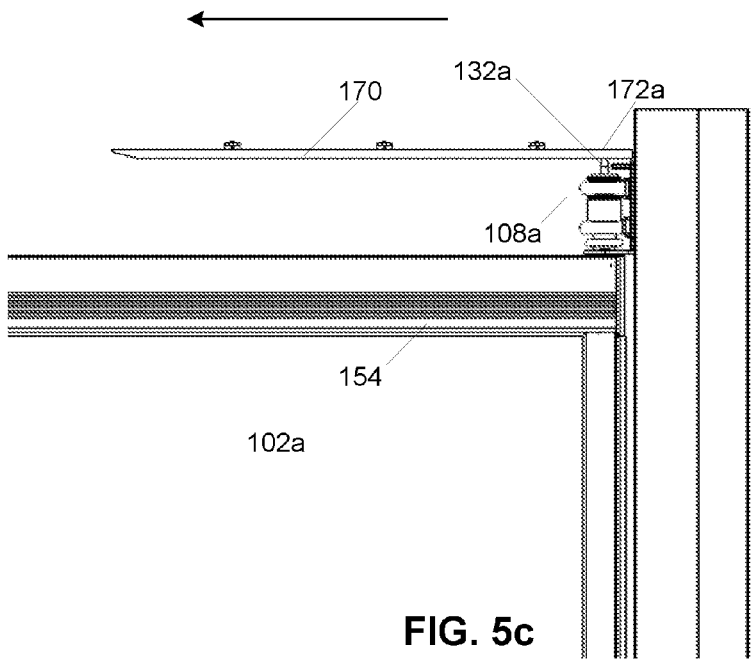
FIG. 5*c* is a view of the system from the inside, looking particularly at the upper hinge wheel assembly and the hinge block.
Figure 5D:
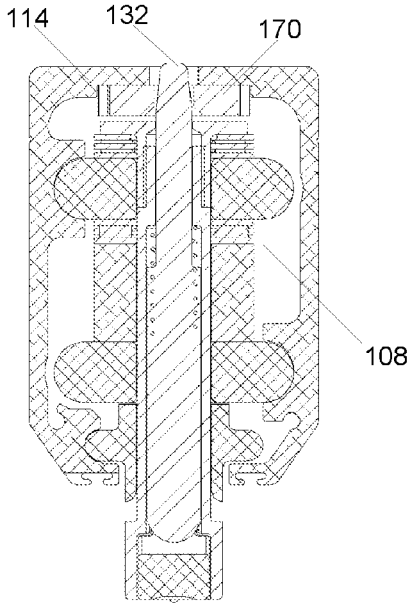
FIG. 5*d* is a cross-sectional view of the upper rail, hinge block, and upper hinge wheel assembly.

FIG. 5*a* is a perspective view of a top portion of a slidable element underneath a hinge block, as viewed from the back of the system, in accordance with an embodiment of the invention. FIG. 5*b* is a top view of the top portion of the slidable element, in accordance with an embodiment of the invention. FIG. 5*c* is a view of the system from the inside, looking particularly at the upper hinge wheel assembly and the hinge block, in accordance with an embodiment of the invention. FIG. 5*d* is a cross-sectional view of the upper rail, hinge block, and upper hinge wheel assembly, in accordance with an embodiment of the invention. The hinge block 170 is affixed to the underside of the upper rail 114 in the hinge block cavity 124 (hinge block cavity visible in FIGS. 3*c* and 4*f*, although the upper rail is not depicted in FIGS. 5*a*-5*c* to aid in viewing and understanding, and both the hinge block and upper rail are not depicted in FIG. 5*b* for the same reason).

The hinge block has a plurality of locator holes 172, each locator hole corresponding to a particular slidable element. The locator hole 172*a* closest to the stacking end of the movable closure system receives the locator pin 132*a* of the upper hinge wheel assembly 108*a* slidable element 102*a* closest to the stacking end of the movable closure system, for example. As previously discussed, when a slidable element is pulled open, the button 146 of the free wheel assembly 106 is engaged by the ramped surface of the insert guide 104 while the free wheel assembly exits the insert guide. The ramped surface of the insert guide presses the button down and in turn causes the locator pin to be raised via the actuators 160 and 166, clicker 168 and pushrod 152. The raised locator pin is received by the corresponding locator hole in the hinge block. With the locator pin in place within the hinge block, the slidable element may rotate about an axis extending through the locator pin downward to the bottom wheel assembly.

When subsequent slidable elements are slid underneath the hinge block, the upper hinge wheel assembly's locator pin of each slidable element is engaged with a subsequent hole in the hinge block. It may be seen that a portion of the hinge block is beveled for engaging the locator pin of the upper hinge wheel assembly, pressing it down as the locator pin passes underneath the hinge block while the slidable elements are in motion.

Figure 6A:
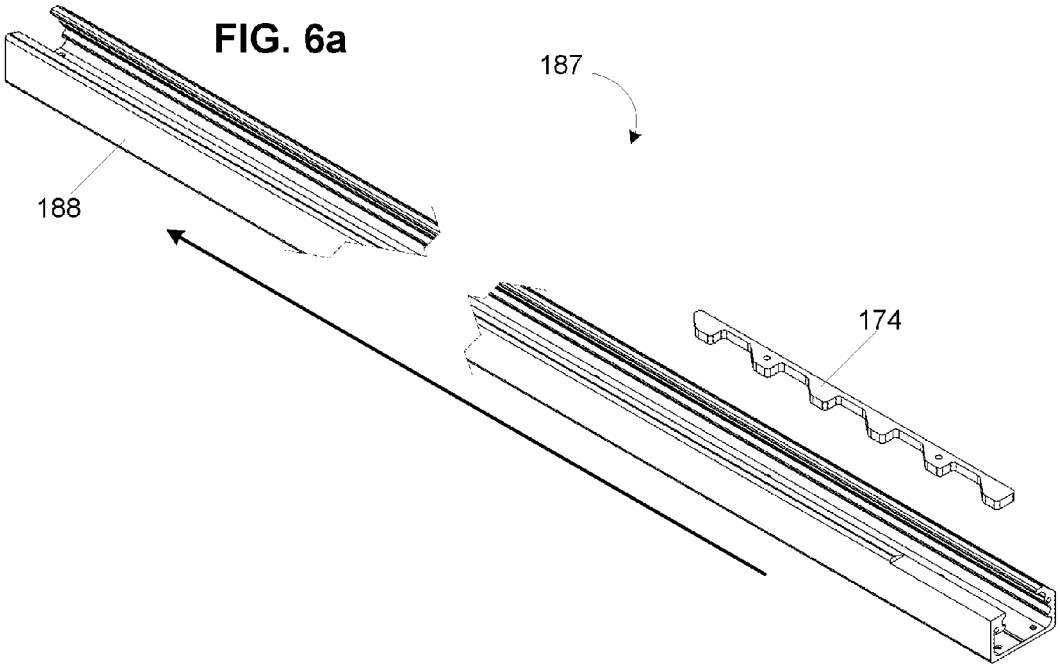
FIG. 6*a* is a perspective view of a lower track of the movable closure system.
Figure 6B:
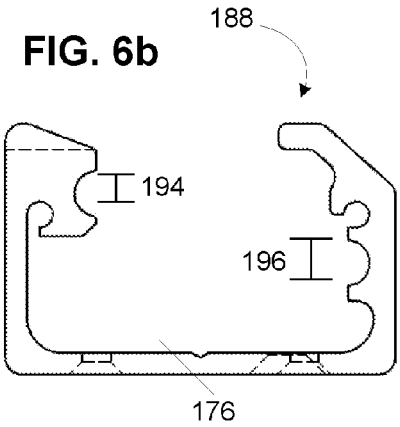
FIG. 6*b* is a side view of a lower rail.
Figure 6C:
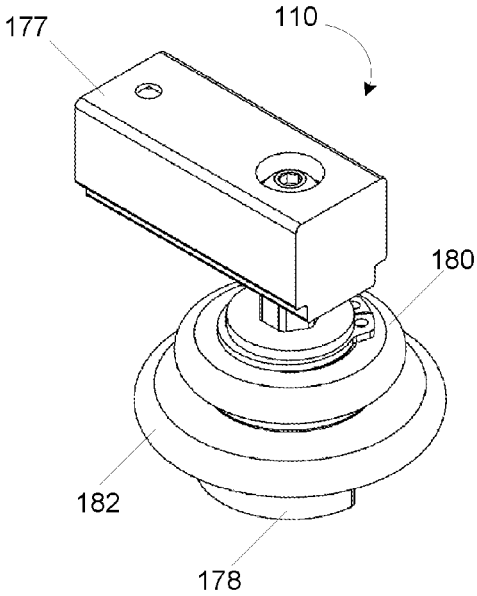
FIG. 6*c* is a perspective view of a lower hinge wheel assembly.
Figure 6D:
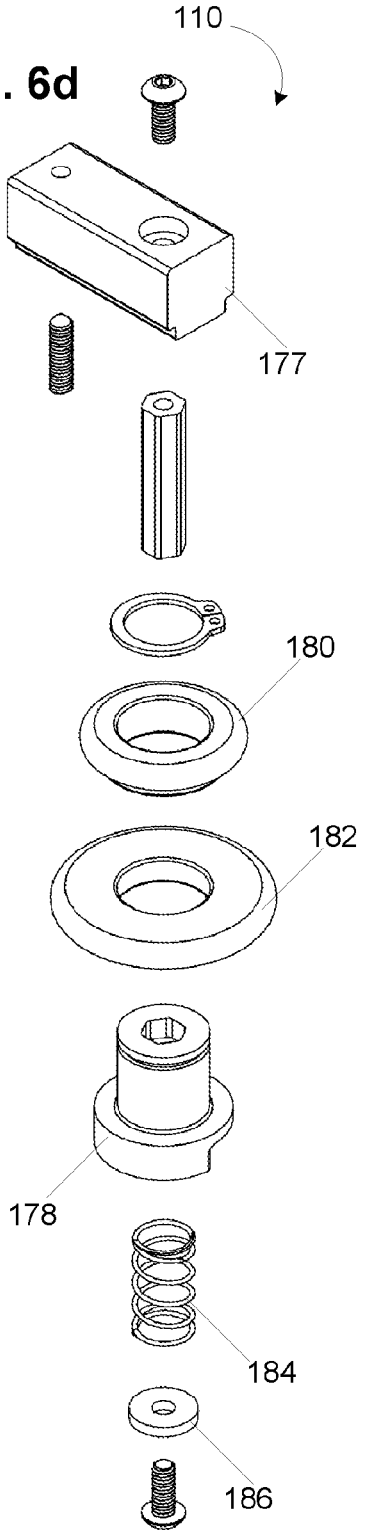
FIG. 6*d* is an exploded view of a lower hinge wheel assembly.
Figure 6E:
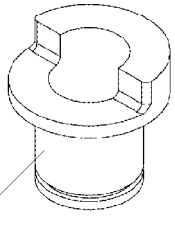
FIG. 6*e* is a perspective view of a lower hinge wheel assembly wheel hub.
Figure 6F:
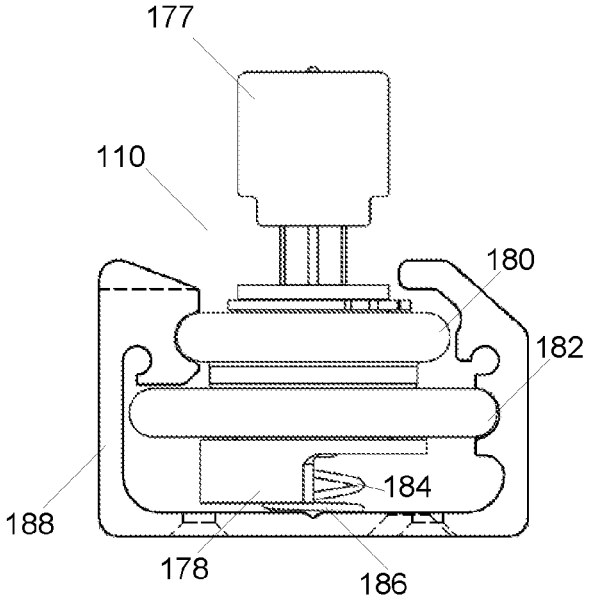
FIG. 6*f* is a side view of the lower track of the movable closure system with the lower hinge wheel assembly in view.

FIG. 6*a* is a perspective view of a lower track of the movable closure system, in accordance with an embodiment of the invention. FIG. 6*b* is a side view of a lower rail, in accordance with an embodiment of the invention. FIG. 6*c* is a perspective view of a lower hinge wheel assembly, in accordance with an embodiment of the invention. FIG. 6*d* is an exploded view of a lower hinge wheel assembly, in accordance with an embodiment of the invention. FIG. 6*e* is a perspective view of a lower hinge wheel assembly wheel hub, in accordance with an embodiment of the invention. FIG. 6*f* is a side view of the lower track of the movable closure system with the lower hinge wheel assembly in view, in accordance with an embodiment of the invention. In some embodiments, an adjustable lower track 187 includes a lower rail 188 and a lower hinge block 174. The lower hinge block is laterally disposed within a lower rail hinge block recess 176. A lower rail includes two channels configured for traversal by idler wheels of the lower hinge wheel assembly 110. Particularly, a lower rail small idler wheel channel 194 receives a lower hinge wheel assembly small idler wheel 180. Additionally, a lower rail large idler wheel channel 196 receives a lower hinge wheel assembly large idler wheel 182. Further, a lower rail hinge block recess 176 is configured for receiving the lower hinge block. The lower hinge block is placed closest to the back side of the movable closure system.

Lower hinge wheel assembly 110 includes baseplate 177, which is affixed to a slidable element in an interior recess of the lower glazing profile 190 (the location of lower glazing profile visible in FIG. 2). A lower hinge wheel assembly wheel hub 178 is suspended from the baseplate with fasteners, and the lower hinge wheel assembly idler wheels rotate about the lower hinge wheel assembly wheel hub. A lower compression spring 184 is retained by lower spring retainer 186. The lower compression spring and lower spring retainer ensure that the wheels travel smoothly through the adjustable lower track, even if the adjustable lower track is not completely level.

It will be noted that the lower hinge wheel assembly wheel hub 178 has a crescent section, the crescent section disposed within the lower rail hinge block recess when the movable closure system is assembled. When a slidable element is pivoted, the lower hinge wheel assembly wheel hub pivots with the slidable element, rotating the crescent section. Additionally, the lower hinge block has a series of notches along its length, each notch corresponding to a particular slidable element. The notch closest to the back side of the movable closure system corresponds to the slidable element closest to the back side of the movable closure system (the element which is pivoted first when the system is being opened). The notches receive the crescent section of the lower hinge wheel assembly wheel hub to prevent the bottom portion of a slidable element from moving except to rotate about the hinge axis.

Figure 7A:
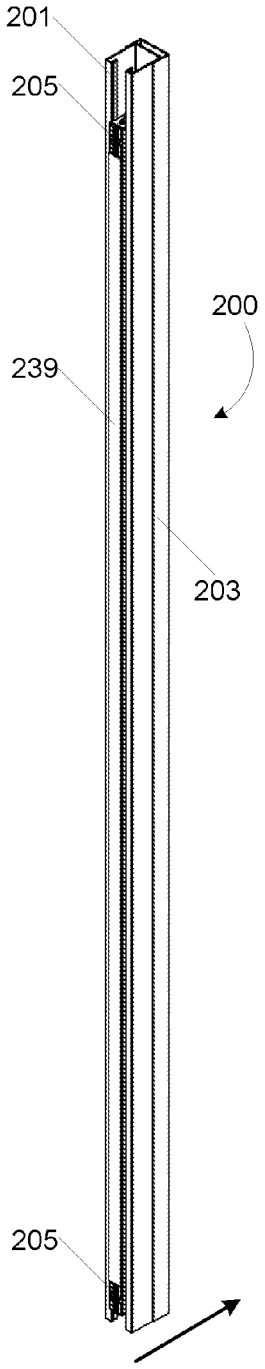
FIGS. 7*a* and 7*b* are a perspective view and an exploded perspective view of a static jamb.
Figure 7B:
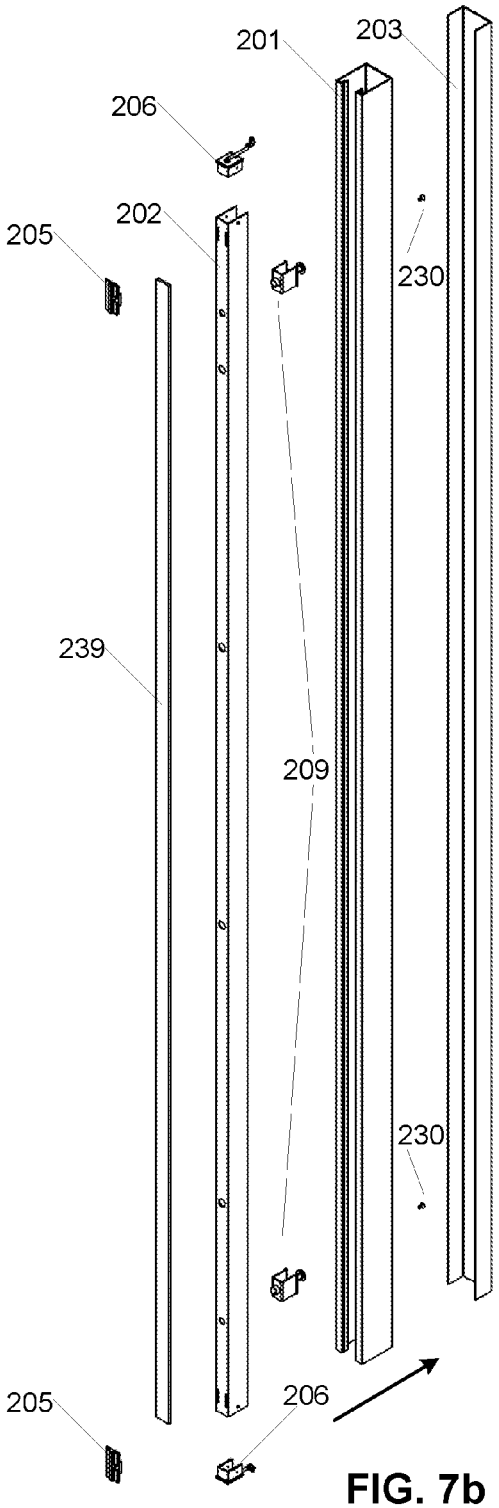
Figure 7C:
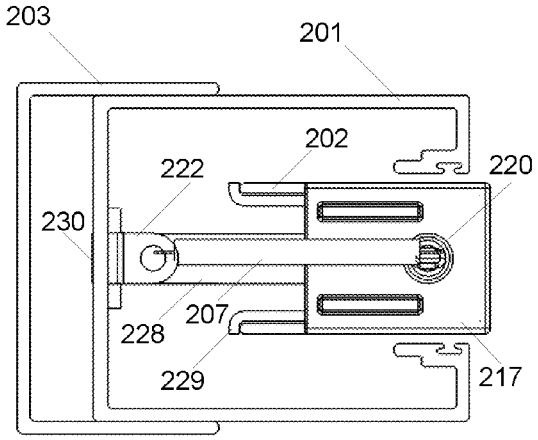
FIG. 7*c* is a top view of a portion of the static jamb.
Figure 7D:
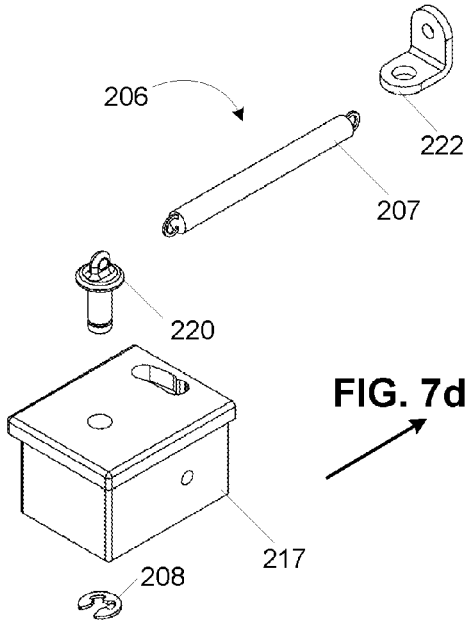
FIG. 7*d* is an exploded perspective view of a static endcap assembly.
Figure 7E:
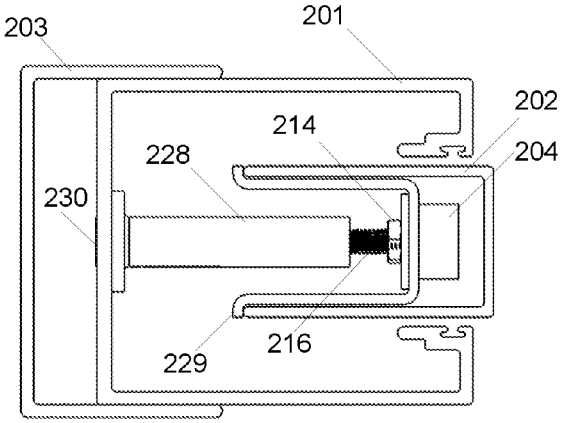
FIG. 7*e* is a top view of a portion of the static jamb.
Figure 7F:
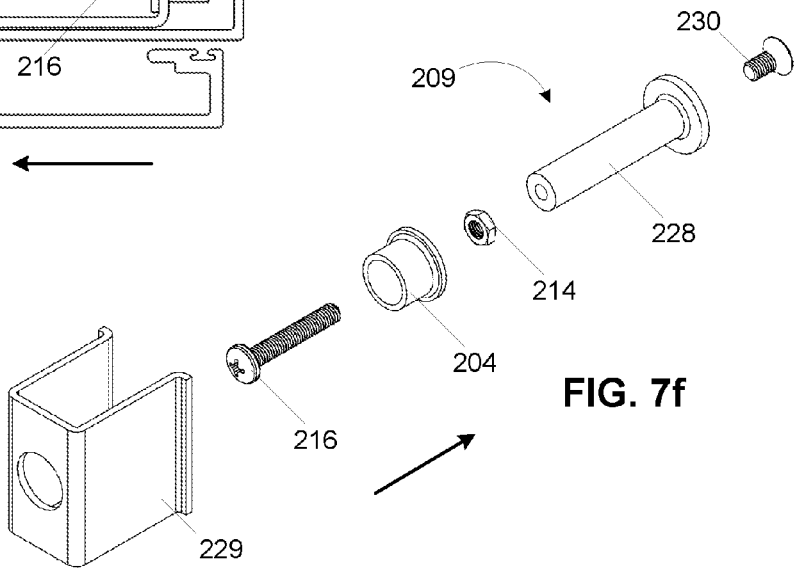
FIG. 7*f* is an exploded perspective view of an adjustment post subassembly.

FIGS. 7*a* and 7*b* are a perspective view and an exploded perspective view of a static jamb, in accordance with an embodiment of the invention. FIG. 7*c* is a top view of a portion of the static jamb, in accordance with an embodiment of the invention. FIG. 7*d* is an exploded perspective view of a static endcap assembly, in accordance with an embodiment of the invention. FIG. 7*e* is a top view of a portion of the static jamb, in accordance with an embodiment of the invention. FIG. 7*f* is an exploded perspective view of an adjustment post subassembly, in accordance with an embodiment of the invention. In some embodiments, static jamb 200 is installed within the aperture through the structure at the closure end 122 of the movable closure system 100 (see FIG. 1*a*). Upon installation of the system, the slidable element closest to the closure end (i.e. the slidable element which opens last and closes first, shown as element 102*c* in FIG. 1*a*) is adjacent to the static jamb. The static jamb is opposite to the compression jamb 400, which is installed within the aperture through the structure adjacent to the stacking end 120 of the system (the end where the movable elements will be stacked upon opening the system).

During installation of the movable closure system, minor adjustments (+/− an inch, for example) to the size of the static jamb may be performed as one means of ensuring an optimal and sealed fit of the slidable elements between the static jamb and compression jamb when the movable closure system is closed. The adjustments to the static jamb are intended to be made during installation through operation of two adjustment post subassemblies 209 as described below. The adjustments provide means for an installer to account for tolerance issues of the system and the aperture in which it is being installed. Once the adjustments to the size are made, the adjustment post subassemblies are covered by other components of the static jamb (rubber seal 239 and endcaps 205, e.g.) and inaccessible to the user.

The static jamb includes a static C-channel 203 which is attached to the side of the aperture through the structure for the system opposite to where the slidable elements are to stack. A static side rail 201 is couplably received by the static C-channel. At installation, the installer uses fasteners augmented with other materials as needed (shims, e.g.) to couple the static side rail with the static C-channel and ensure the static side rail is plumb, even if the static C-channel attached to the structure within the side of the aperture is not.

A static compression bar 202 is received by a recess in the static side rail. The static compression bar is held in place against the static side rail in part with static endcap assemblies 206 located at each end of the static compression bar. A first tension spring 207 couples a first static endcap assembly at the top of the static compression bar to a spring bracket 222 attached (with rivets or threaded fasteners, e.g.) near the top of the static side rail, and a second tension spring couples the second static endcap assembly to another spring bracket attached near the bottom of the static side rail. The static endcap assemblies (specifically, the bar endcaps 217 of the static endcap assemblies) are attached to the top and bottom of the static compression bar. A hook pivot pin 220 to which the tension spring attaches is disposed through the bar endcap and secured by retaining clip 208. The two tension springs, coupling the two spring brackets attached to the static side rail with the hook pivot pins of the two static endcap assemblies attached to the static compression bar, tensionally bias the static compression bar in the direction of the static side rail. The spring tension thus pulls the static compression bar and static side rail towards each other. Additional structural support for the static compression bar is provided by its position between the upper track and lower track of the system (see FIG. 1*a*).

At installation, the spring tension and hence the distance between the static compression bar and static side rail may be adjusted through two adjustment post subassemblies 209 mounted to the static side rail and in contact with the static compression bar. Particularly, edges of the static compression bar facing the static side rail come into contact with flange portions of the adjustment post subassemblies, limiting the tensional bias provided by the tension springs of the static compression bar towards the static side rail.

As may be best seen in FIGS. 7*b*, 7*e*, and 7*f*, the adjustment post subassemblies are disposed between the static side rail and the static compression bar. Each adjustment post subassembly is held in place along the static side rail by a mounting screw 230, which is disposed through an aperture through the static side rail and threaded into a threaded interior channel of guide post 228. The opposing side of the guide post has another threaded interior channel for receiving a machine screw 216 with an attached screw bucket 204. The machine screw is passed through an aperture at the bottom of the bucket portion of the screw bucket, the screw bucket being held in place underneath the head of the machine screw with locknut 214. The machine screw, with the screw bucket attached below the head of the machine screw by the locknut and the opening of the bucket portion of the screw bucket opposite to the threaded portion of the machine screw, is partially threaded into the guide post.

The bucket portion of the screw bucket has an outer diameter sized slightly smaller than the diameter of an aperture through the center of standoff 229. The screw bucket also has a shelf portion (the shelf portion being co-located with the plane through the bottom of the bucket portion that has the aperture for the machine screw) with a diameter larger than the diameter of the aperture through the center of the standoff. The standoff is seated over the bucket portion of the screw bucket (i.e. the bucket portion passed through the aperture through the center of the standoff) so that the shelf portion of the screw bucket rests against a bottom face of the standoff. The standoff has flanges interfacing with the vertical edges of the static compression bar facing the static side rail. The biasing action of the tension spring which brings the static compression bar towards the static side rail is limited by the flanges of the standoff, the position of which is set by the depth of the machine screw and the screw bucket relative to the guide post.

The adjustment in distance between the static compression bar and static side rail is controlled by the installer through operation of the machine screws using a screwdriver. Previous to adhering the rubber seal 239 to the static compression bar, the heads of the machine screws may be accessed with the screwdriver shaft passing through apertures in the static compression bar that are aligned with the adjustment post assemblies and the bucket portions of the screw buckets. The standoffs are moved laterally through motion transferred to them by screwdriver rotation of the machine screws, attached screw buckets, and standoffs, in conjunction with the tension springs. If the screwdriver interfaced with an adjustment post assembly is turned counter-clockwise, the end of the static compression bar nearest to the adjustment post assembly is pulled away from the static side rail as the machine screw rotates out from the guide post and away from the static side rail to which the guide post is mounted. Particularly, the screw bucket attached to the machine screw moves away from the guide post in tandem with the machine screw, and the shelf portion of the screw bucket pulls the standoff in turn. The pulling motion of the standoff away from the static side rail is transferred to the static compression bar by the flanges of the standoff interfacing with the edges of the static compression bar nearest the static side rail. The lateral expansion of the adjustment post assembly therefore works against (i.e. increases) the spring tension pulling the static compression bar towards the static side rail.

If the screwdriver interfaced with the adjustment post assembly is turned clockwise, the end of the static compression bar nearest to the adjustment post assembly moves closer to the static side rail as the machine screw rotates into the guide post and towards the static side rail to which the guide post is mounted. Particularly, the screw bucket attached to the machine screw moves towards the guide post in tandem with the machine screw. The tension imparted by the tension spring pulls the static compression bar towards the static side rail as the machine screw is turned, the travel of the static compression bar being limited by the interface of its edges against the flanges of the standoff, the standoff having been positioned by the machine screw, screw bucket, and standoff. As the adjustment post assembly compresses in conjunction the machine screw being rotated into the guide post, the spring tension pulling the static compression bar towards the static side rail is released.

Figure 8A:
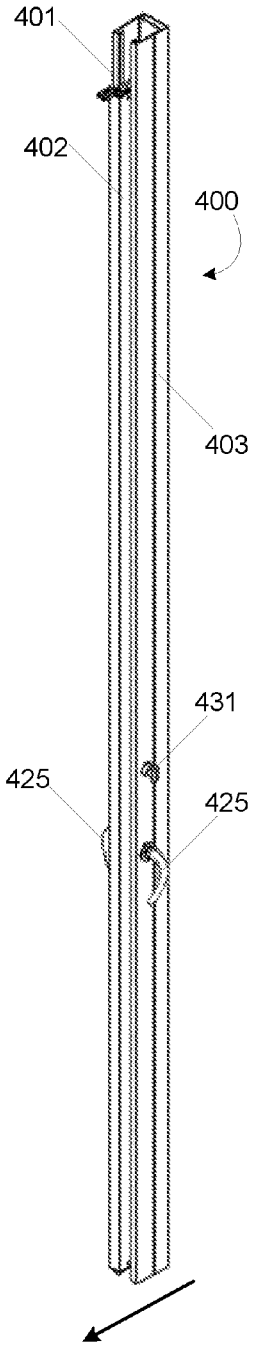
FIGS. 8*a* and 8*b* are a perspective view and an exploded perspective view of a compression jamb.
Figure 8B:
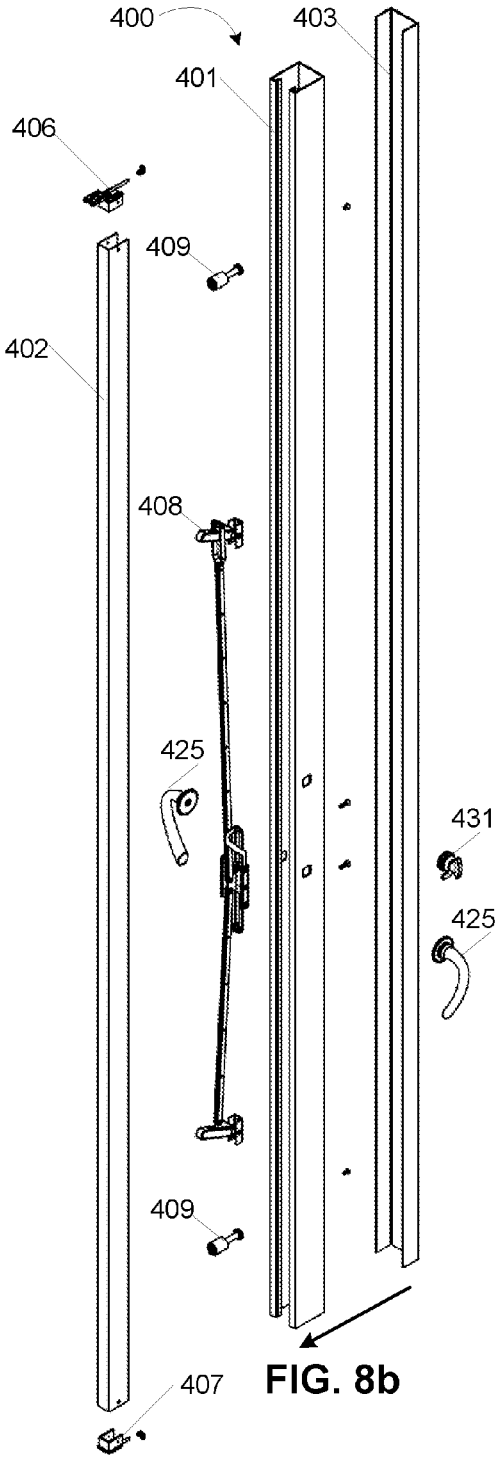
Figure 8C:
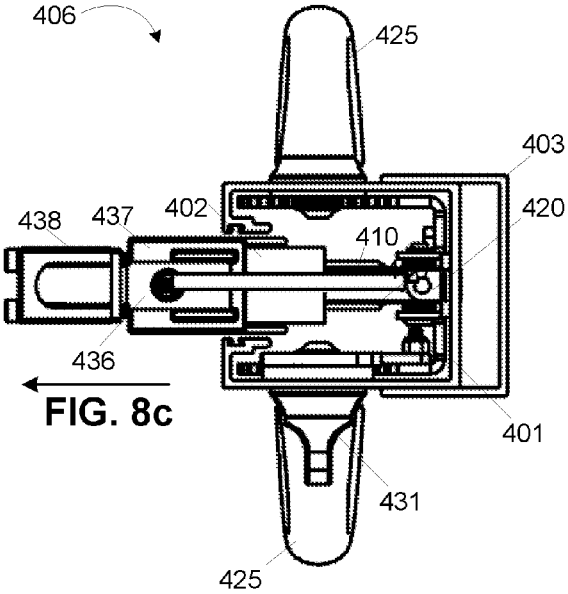
FIG. 8*c* is a top view of the compression jamb.
Figure 8E:
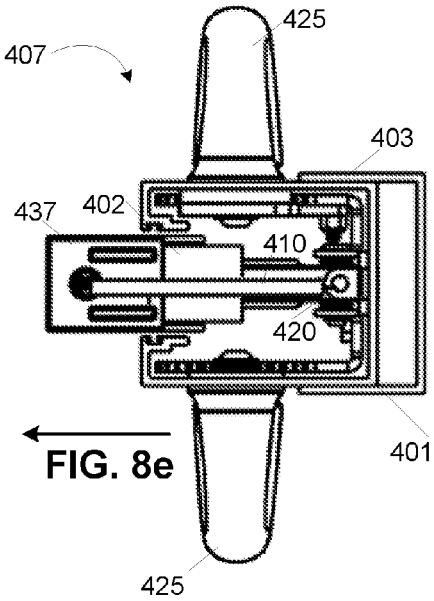
FIG. 8*e* is a bottom view of the compression jamb.
Figure 8D:
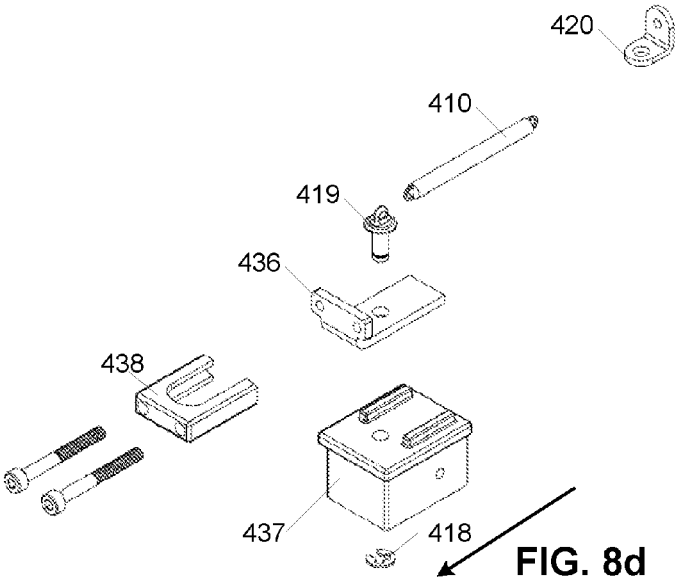
FIG. 8*d* is an exploded perspective view of a compression jamb top endcap assembly.

FIGS. 8*a* and 8*b* are a perspective view and an exploded perspective view of a compression jamb, in accordance with an embodiment of the invention. FIG. 8*c* is a top view of the compression jamb, in accordance with an embodiment of the invention. FIG. 8*d* is an exploded perspective view of a compression jamb top endcap assembly, in accordance with an embodiment of the invention. FIG. 8*e* is a bottom view of the compression jamb, in accordance with an embodiment of the invention. In some embodiments, compression jamb 400 is installed within the aperture through the structure at the stacking end 120 of the movable closure system (see FIG. 1*a*). Upon installation of the system, the slidable element closest to the stacking end (i.e. the slidable element which opens first and closes last, shown as first slidable element 102*a* in FIG. 1*a*) is adjacent to the compression jamb. The compression jamb includes a compression jamb C-channel 403. (Hereafter, parts of the compression jamb with similar names to that of the static jamb or tracks, e.g. the C-channel, will be given a prefix of CJ for "compression jamb." For example, the compression jam compression bar will be referred to as the CJ compression bar to distinguish it from the static compression bar, etc.). The CJ C-channel 403 is attached to the side of the aperture through the structure for the system adjacent to where the slidable elements are to stack. A CJ side rail 401 is couplably received by the CJ C-channel. At installation, the installer uses fasteners augmented with other materials as needed (shims, e.g.) to couple the CJ side rail with the CJ C-channel and ensure the CJ side rail is plumb, even if the CJ C-channel attached to the structure within the side of the aperture is not.

A CJ compression bar 402 is received by a recess in the CJ side rail. The CJ compression bar is held in place against the CJ side rail in part with two CJ compression bar endcap assemblies. Particularly, a CJ top bar endcap assembly 406 is attached to the CJ compression bar at its top, and a CJ bottom bar endcap assembly 407 is attached to the CJ compression bar at its bottom. A first tension spring 410 couples the CJ top bar endcap assembly to a CJ spring bracket 420 attached near the top of the CJ side rail, and a second tension spring couples the CJ bottom bar endcap assembly to another CJ spring bracket attached near the bottom of the CJ side rail. Each of the CJ top bar endcap assembly and the CJ bottom bar endcap assembly have a hook pivot pin 419 disposed through the CJ bar endcap 437 and secured by retaining clip 418. In the case of the CJ top bar endcap assembly, the hook pivot pin is first inserted through drawbar 436, which is nestled in between protrusions extending from the top surface of the CJ bar endcap, before the hook pivot pin passes through the CJ bar endcap. A connector loop 438 is attached to the drawbar to complete the CJ top bar endcap assembly. As will be described below, the connector loop is disposed about the wheel hub of the upper hinge wheel assembly of the first slidable element adjacent to the compression bar. As may be seen by comparing FIGS. 8*c* and 8*e*, while the CJ top bar endcap assembly is coupled with a drawbar and connector loop, the CJ bottom bar endcap assembly is not.

As previously disclosed, after installation the compression jamb may be operated via handle 425. During closure of the system, subsequent to pivoting each of the slidable elements into alignment with the track and sliding them towards the closure end 122, handle 425 may be rotated to the six o'clock position to control the expansion of a portion of the compression jamb towards the slidable element immediately adjacent to it. Specifically, the handle is linked with compression mechanism 408, which includes pivoting elements that push against the CJ compression bar 402 moving it away from the CJ side rail 401. The pushing action of the compression mechanism extends the tension springs 410 that couple the CJ compression bar and the CJ side rail.

The action of rotating the handle to extend the CJ compression bar from the compression jamb has several effects. First, the extended CJ compression bar compresses all the slidable elements against one another and against the static jamb at the closure end of the system, sealing the entire movable closure system, compressing the weatherstrips, and interlocking adjoining male and female endcaps of the slidable elements. Second, it moves the free wheel assembly of the first slidable element away from the insert guide such that the first slidable element is prevented from being rotated out of alignment with the tracks. The free wheel assembly, being out of alignment with the insert guide, would be retained by the adjustable upper track if pressure were applied to the handle of the first slidable element. Third, the first panel interlock would slide underneath a hanging vertical tab of the insert guide such that the first panel interlock would be barred by the vertical tab if pressure were applied to the handle of the first slidable element. Fourth, an extension of the compression mechanism rotates into position where the latch may engage with it, preventing the handle on the outside of the system from being operated.

Figure 9A:
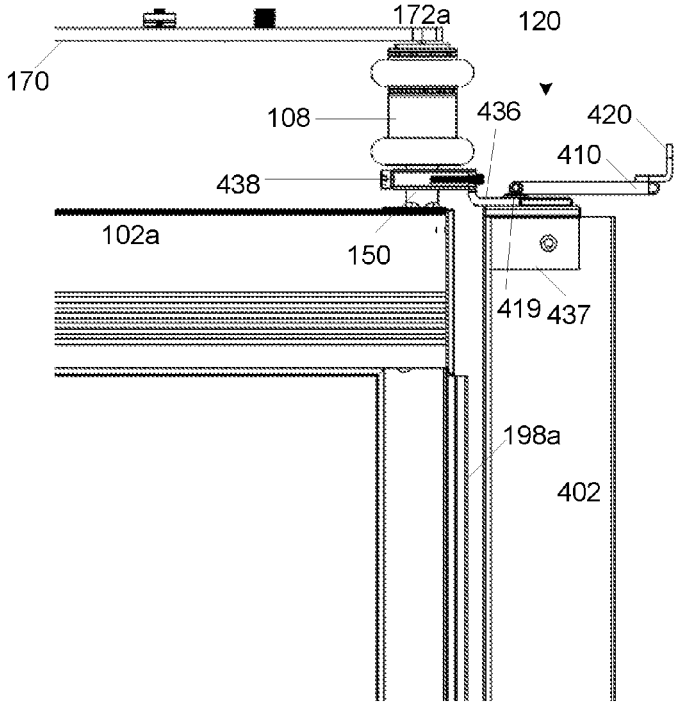
FIGS. 9*a* and 9*b* are two front partial cutaway views of portions of the movable closure system.
Figure 9B:
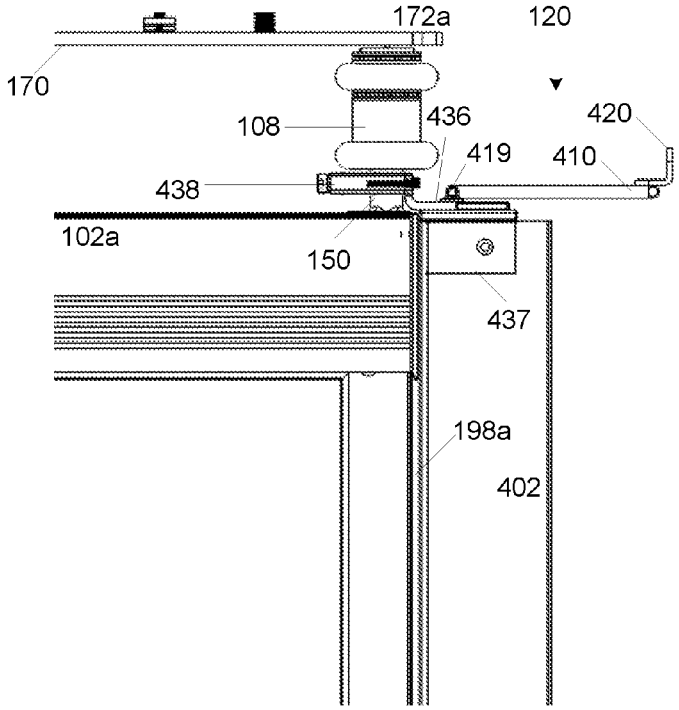

FIGS. 9*a* and 9*b* are two front partial cutaway views of portions of the movable closure system, in accordance with an embodiment of the invention. FIGS. 9*a* and 9*b* depict a portion of the first slidable element 102*a* in relation to a top portion of the CJ compression bar 402, the hinge block 170 of the adjustable upper track, and the top CJ spring bracket 420 attached to the interior of the CJ side rail near its top, all of which are disposed at the stacking end of the system 120. For ease of viewing and understanding, certain components are not depicted in FIGS. 9*a* and 9*b* including the adjustable upper track's upper rail and C-channel and including the compression jamb's CJ side rail and CJ C-channel, but it will be understood that in an actual installation the foregoing components would likely be present.

FIG. 9*a* shows the first slidable element in alignment with the tracks previous to operation of the compression jamb during a closing operation of the system. It will be noted that a gap exists between the CJ compression bar and the weatherstrip 198*a* of the first slidable element. It should also be noted that the locator pin of the upper hinge wheel assembly 108 is extended into the corresponding locator hole 172*a* of the hinge block 170. It will also be seen that the CJ tension spring 410 is compressed, such that the CJ compression bar would be retracted into the CJ side rail of the compression jamb. It may also be seen that connector loop 438, which is mounted by drawbar 436 to the CJ compression bar by way of CJ compression bar endcap 437, is disposed about the hinge wheel assembly wheel hub 150.

FIG. 9*b* shows the first slidable element in alignment with the tracks subsequent to operation of the compression jamb during a closing operation of the system. As will be discussed more fully below, operation of the handle of the compression jamb extends the CJ compression bar 402 by way of a compression mechanism linked with the handle that comes into contact with the CJ compression bar, pushes it away from the stacking end 120, and making contact with the edge of the first slidable element 102*a* closest to the stacking end. The pressure applied by the compression mechanism to the CJ compression bar compresses the weatherstrip 198*a*, creating a seal between the CJ compression bar and the first slidable element. The first slidable element is pushed towards the closure end of the system. Any slidable elements between the first slidable element and the static jamb are pushed towards the static jamb in turn, and the weatherstrips of each adjoining slidable element compress as does a rubber seal of the static jamb. It will be noted that the gap between the CJ compression bar 402 and the weatherstrip 198*a* has closed. It should also be noted that the upper hinge wheel assembly 108 has moved away from the stacking end 120 and no longer rests directly below the locator hole 172*a* of the hinge block 170 intended for the first slidable element. It will also be seen that the CJ tension spring is extended by the push of the CJ compression bar by the compression mechanism while the CJ side rail to which the CJ spring bracket is attached remains in place. It may also be seen that the hinge wheel assembly wheel hub 150 is disposed to the opposite side of the connector loop 438 from its position in FIG. 9*a*.

It will be understood through viewing FIG. 8*b* that at the bottom portion of the CJ compression bar 402, another CJ compression spring links the CJ bar bottom endcap assembly 407 with a CJ spring bracket attached to the interior of the CJ side rail near its bottom. During the foregoing operation of the handle of the compression jamb during a closing operation of the system, the compression mechanism in contact with the CJ compression bar also extends the CJ tension spring linking the CJ bar bottom endcap assembly with the CJ spring bracket attached to the interior of the CJ side rail near its bottom.

Returning to FIG. 9*a*, it may be seen that during an opening operation of the system in which the handle of the compression jamb is operated again, the compression mechanism disengages from the CJ compression bar and it is retracted towards the stacking end of the system. Particularly, the spring tension imparted to the CJ tension springs is released, and the CJ tension springs draw the CJ compression bar back into the recess of the CJ side rail. The first slidable element 102*a* is moved towards the stacking end in turn by virtue of the coupling of the CJ compression bar via connector loop 438 disposed about the hinge wheel assembly wheel hub 150 and the drawbar 436 attached to the CJ compression bar by the upper CJ compression bar endcap 437. The foregoing movement of the first slidable element towards the stacking end of the system helps to move the locator pin of the first slidable element's upper hinge wheel assembly 108 underneath the locator hole 172*a* defining the top portion of the axis of rotation about which the first slidable element may pivot.

As previously disclosed, upon the first slidable element reaching the position where the locator pin of the upper hinge wheel assembly is directly below the corresponding locator hole, the upper free wheel assembly is aligned with the insert guide. The first slidable element may then be pivoted, causing the locator pin to extend into the hinge block as the upper free wheel assembly exits the insert guide.

It will be noted that the first slidable element 102*a* is not required to move substantially in order to pivot open. The lateral movement of the first slidable element ranges from the position where it may be pivoted open (i.e. when the locator pin of its upper hinge wheel assembly is immediately below the corresponding locator hole 172*a* of hinge block 172) to the position where the first panel interlock interfaces with the vertical tab of the insert guide (i.e. the position to which the CJ compression bar pushes the first slidable element when the system is closed via operation of the compression jamb).

Figures 10A, 10B, 11A, 11B:
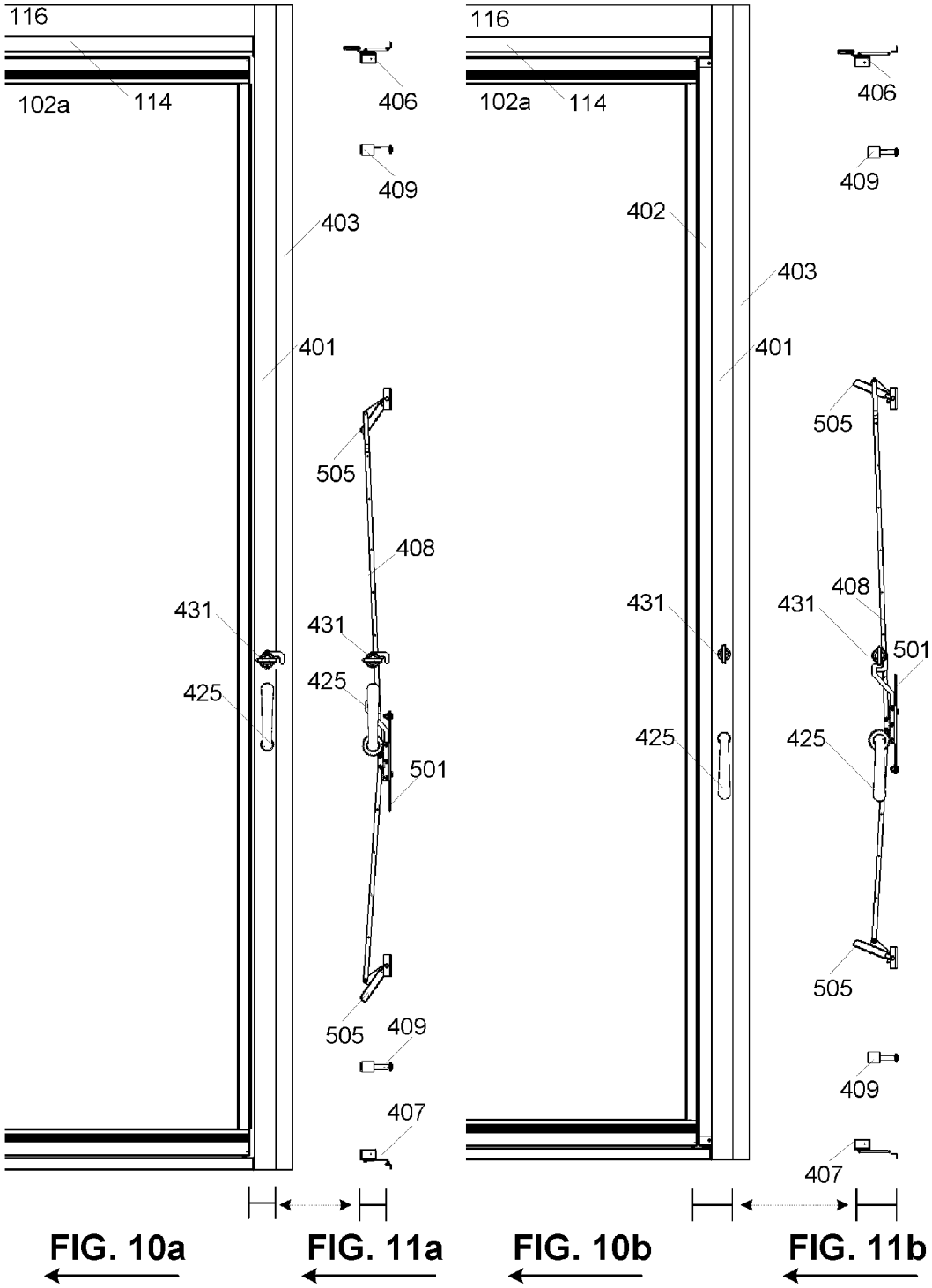
FIGS. 10*a* and 10*b* are two front views of a portion of the movable closure system.
FIGS. 11*a* and 11*b* are two cutaway views of portions of a compression jamb.

FIGS. 10*a* and 10*b* are two front views of a portion of the movable closure system, and FIGS. 11*a* and 11*b* are two cutaway views of portions of a compression jamb, in accordance with an embodiment of the invention. FIGS. 10*a* and 10*b* depict a portion of the first slidable element 102*a* in relation to aspects of a compression jamb, including the CJ compression rail 401, CJ compression bar 402, compression mechanism 408, and aspects of the adjustable upper track including upper C-channel 116 and upper rail 114. FIGS. 11*a* and 11*b* depict certain aspects of the compression jamb with other aspects being removed for ease of viewing and understanding. It will be understood that in an actual installation all components of the compression jamb would likely be present. For this presentation of the workings of the system, FIGS. 11*a* and 11*b* correspond to their counterparts FIGS. 10*a* and 10*b* and show the interior components related to the operation of the compression jamb.

FIG. 10*a* shows the first slidable element in alignment with the tracks previous to operation of the compression jamb during a closing operation of the system. It will be noted that a gap exists between the CJ side rail 401 of the compression jamb and slidable element 102*a*, and that the CJ compression bar is not visible due to its retraction into the CJ side rail. It should also be noted in both FIGS. 10*a* and 11*a* that handle 425 of the compression jamb is in the 12 o'clock position (i.e. pointing towards the latch 431). It will also be seen that the latch 431 is in an open position (i.e. with the latch cam rotated outwards, towards the stacking end of the system). In FIG. 11*a* it may also be seen (but not in FIG. 10*a* albeit still true) that pogos 505 of the compression mechanism 408 are in a lowered position aimed towards the bottom of the system. It will also be seen that the CJ bar endcap assemblies 406 and 407 are not extended because of the spring tension and their coupling with the CJ spring brackets. The spring tension retracts the CJ compression bar which is disposed (but not visible in FIG. 11*a*) vertically between the two CJ bar endcap assemblies. It can also be seen that actuator 501 of the compression mechanism 408 is in a low position (relative to FIG. 11*b*) and away from latch 431. Also visible in FIG. 11*a* are bumpstop assemblies 409, which are attached to the interior of the recess of the CJ side 401 and serve as bumpers to soften any impact occurring when the CJ compression bar is retracted by the tension springs.

FIG. 10*b* shows the first slidable element in alignment with the tracks subsequent to operation of the compression jamb during a closing operation of the system. Operation of the handle 425 extends the CJ compression bar from the CJ side rail by way of the handle's linkage with the compression mechanism 408 and its pogos 505, which contact the inside of the CJ compression bar, pushing it away from the stacking end of the system and against the first slidable element 102*a*. It will be noted in FIG. 10*b* that the CJ compression bar 402 is visible due to its extension from the CJ side rail of the compression jamb, and that the gap between the compression jamb and the first slidable element 102*a* has closed. It should also be noted in both FIGS. 10*b* and 11 *b* that handle 425 of the compression jamb is in the 6 o'clock position (i.e. pointing towards the bottom of the system). It will also be seen that the actuator 501 of the compression mechanism is in high position (relative to FIG. 11*a*), and that the latch 431 is in a closed position (i.e. with the latch cam rotated clockwise to engage a portion of the actuator). In FIG. 11*b* it may also be seen (but not in FIG. 10*b* albeit still true) that pogos 505 of the compression mechanism 408 are in a raised position aimed towards the top of the system. It will also be seen that the CJ bar endcap assemblies 406 and 407 are extended away from the stacking end of the system, lengthening the tension springs attaching the CJ bar endcap assemblies to the CJ side rail via the CJ spring brackets. The CJ bar endcap assemblies, attached at either end of the CJ compression bar, are extended in tandem with the CJ compression bar as the pogos 505 come into contact with the CJ compression bar, pushing the CJ compression bar away from the stacking end of the system and into contact with the first slidable element 102*a*. The pogo extension takes place when handle 425 engages actuator 501 to raise the actuator, which is linked through the compression mechanism to the pogos.

Returning to FIG. 10*a*, it may be seen that during an opening operation of the system in which the handle of the compression jamb is operated again, the rotation of the handle from the 6 o'clock position back to the 12 o'clock position lowers the actuator 501 and lowering the remainder of compression mechanism 408 including pogos 505. (Latch 431, if engaged, is first rotated counter-clockwise, releasing the latch cam's engagement with the actuator.) The pogos stop pushing against the CJ compression bar, and the CJ tension springs draw the CJ compression bar back into the recess of the CJ side rail because of the spring tension and their coupling with the CJ spring brackets attached to the interior of the CJ side rail.

FIGS. 12*a*, 12*b*, and 12*c* are two front views and a right side view of a portion of the movable closures system, in accordance with an embodiment of the invention. FIGS. 12*a*, 12*b*, and 12*c* depict a portion of the first slidable element 102*a* in relation to portions of the adjustable upper track, including upper C-channel 115, upper rail 114, and insert guide 104, and in relation to an adjacent slidable element 102*b*. (It will be understood that in a system with a single slidable element, adjacent to slidable element 102*a* near the closure end would be the static jamb.) Particularly, in view are the upper free wheel assembly of the first slidable element including free wheel assembly wheel hub 148 and free wheel assembly load wheel 142, as well as first panel interlock 608. The first panel interlock includes an angled vertical tab, extending above and away from the top edge of the first slidable element. As can best be seen in FIG.

12*c*, a side cross-sectional view of the adjustable top track and first slidable element 102*a* looking towards the insert guide from the stacking end of the system, the insert guide 104 includes a mating vertical tab underneath which the first panel interlock can pass when the first slidable element is slidably moved towards the closure end of the system. Two locking features are provided by the movement of the first slidable element 102*a* away from the stacking end, the movement depicted beginning in FIG. 12*a* and completed in FIG. 12*b*. First, the push by the CJ compression bar against the first slidable element moves the upper free wheel of the first slidable element (free wheel assembly load wheel 142 and free wheel assembly wheel hub 148, for example) out of alignment with the insert guide. Additionally, the first panel interlock 608 at the top of the first slidable element 102*a* slides underneath the mating vertical hanging tab of the insert guide 104. The foregoing two movements provide physical locking aspects which prevent the first slidable element 102*a* from being pivoted open subsequent to operation of the compression jamb. (As an additional security measure subsequent to operation of the compression jamb, latch 431 may be turned to prevent the compression jamb handle 425 from being moved until the latch is un-latched.) It should also be noted in FIG. 12*b* that, subsequent to operation of the compression jamb during closing of the system, the gap between slidable elements 102*a* and 102*b* visible in FIG. 12*a* is closed, the weatherstrips between the slidable elements are compressed, and the male endcap 205 is mated with female endcap 210.

Figure 13A:
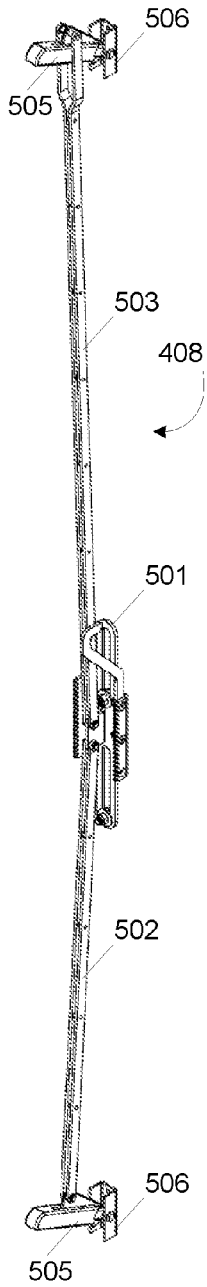
FIGS. 13*a* and 13*b* are a perspective view and an exploded view of the compression mechanism of the compression jamb.
Figure 13B:
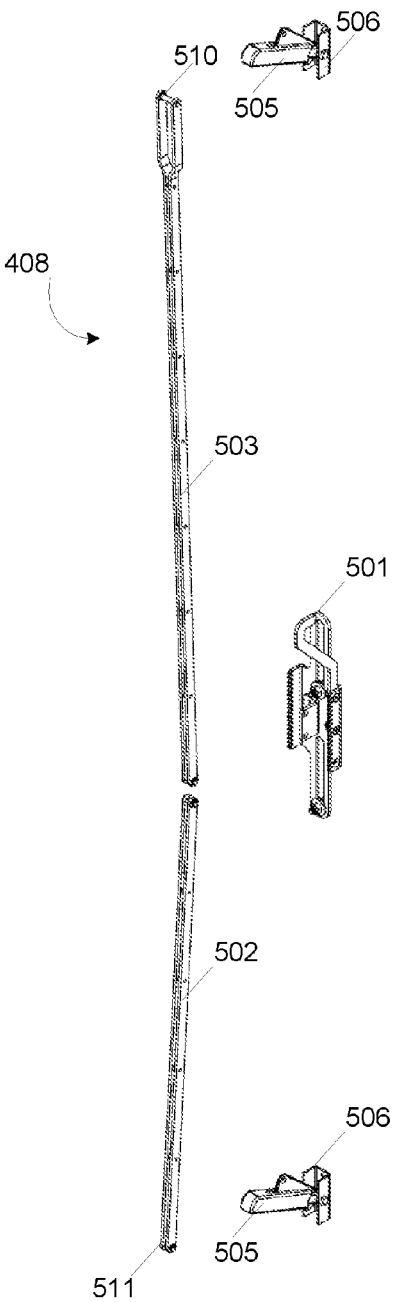
Figure 13C:
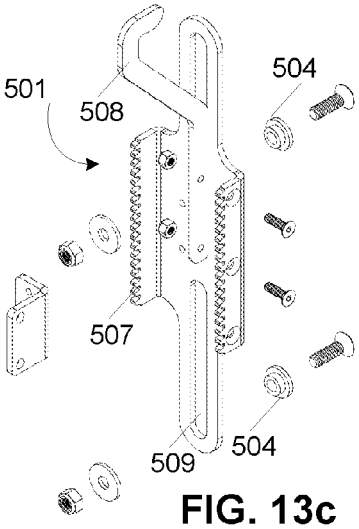
FIG. 13*c* is a perspective view of an actuator of the compression mechanism of the compression jamb.
Figure 13D:
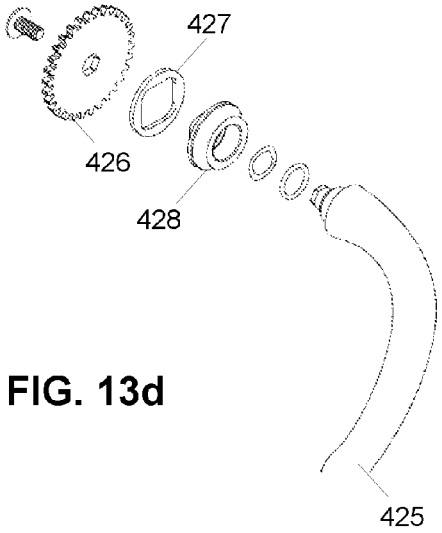
FIGS. 13*d* and 13*e* are exploded views of the handle and of the latch of the compression jamb.
Figure 13E:
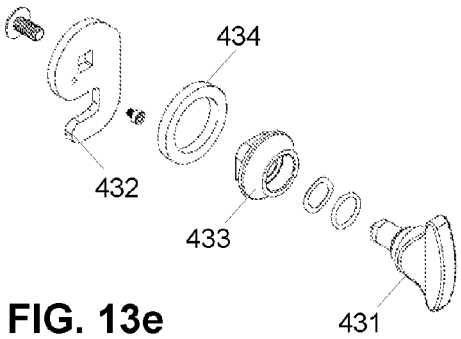
Figure 13F:
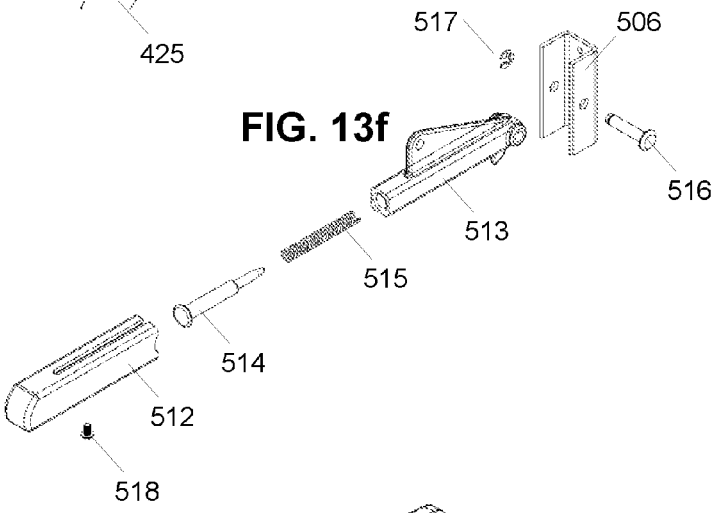
FIG. 13*f* is an exploded view of a pogo of the compression mechanism of the compression jamb.

FIGS. 13*a* and 13*b* are a perspective view and an exploded view of the compression mechanism of the compression jamb, and FIG. 13*c* is a perspective view of an actuator of the compression mechanism of the compression jamb, in accordance with an embodiment of the invention. FIGS. 13*d* and 13*e* are exploded views of the handle and of the latch of the compression jamb, in accordance with an embodiment of the invention. FIG. 13*f* is an exploded view of a pogo of the compression mechanism of the compression jamb, in accordance with an embodiment of the invention. In some embodiment, the compression mechanism 408 includes the actuator 501, the actuator being swivably linked at its bottom to a straight link bar 502, which is in turn swivably linked to pogo 505 at the bottom of the compression mechanism. The actuator is also swivably link to a clevis link bar 503, which is in turn linked to pogo 505 at the top of the compression mechanism. The pogos are linked via pogo brackets 506 to the interior recess of the CJ side rail, as is the actuator. It will be noted that, to reduce the number of parts needed in the system among other reasons, both the upper pogo and lower pogo use the same parts, including the aperture through a portion of the pogos for a link pin with the link bars at the top of the pogos. The clevis link bar is therefore used in conjunction with a clevis pin in order to permit the travel of the pogo through the separated portions of the clevis link bar when the upper pogo swivels. Since nothing interferes with the movement of the link between the actuator and the lower pogo, a straight link bar may be employed instead of a clevis link bar. Turning to FIG. 13*c*, it may be seen that actuator guides 504 are disposed through actuator travel limiters 509. The mounting hardware for the actuator passes through the CJ side rail (see, e.g. FIG. 8*b*), then through the actuator guides, then through the actuator travel limiters before being fastened with a washer and nut arrangement. The effect is that the actuator is able to slide up and down relative to the CJ side rail. The up and down movement is driven by the compression bar handle 425, which turns handle gear 426 which gearably interfaces with actuator teeth 507. (The compression bar handle is mounted using, among other things, handle washer 427 and handle base 428, with the CJ side rail in between the two.) Particularly, rotation of the compression jamb handle 425 counter-clockwise from the 12 o'clock position to the 6 o'clock position (see, e.g. FIGS. 11*a* and 11*b*) moves the actuator upward along the actuator guides attached to the side of the CJ side rail, moving the swivably linked pogos upward in turn. Conversely, rotation of the compression jamb handle 425 clockwise from the 6 o'clock position to the 12 o'clock position moves the actuator downward along the actuator guides, moving the swivably link pogos downward in turn. It should be noted that the foregoing operations are described from the inside of the structure. In some embodiments, a second compression jamb handle may be disposed on the opposite side of the compression jamb and may be operated from the outside of the structure. It may be seen that the actuator has two vertical sets of actuator teeth. One of these interfaces with the handle gear of the compression jamb handle of the system, while another set of actuator teeth interfaces with the handle gear of the compression jamb handle on the outside of the system (if present). It may also be seen that actuator has a latch interface 508 which is configured for mating with latch cam 432. When the actuator is in the upper position (i.e. compression jamb handle in the 6 o'clock position), the latch 431 may be rotated clockwise such that the latch cam 432 mates with the latch interface. (The latch is mounted using, among other things, latch washer 434 and latch body 433, disposed with the CJ side rail in between the two.) This interlocking of the latch cam with the latch interface of the actuator prevents the actuator from traveling downward, disabling opening operations of the system.

Turning to FIG. 13*f*, it may be seen that a pogo includes, but is not limited to, a pogo bracket 506 which attaches to the interior recess of the CJ side rail, a pogo pivot pin about which the pogo swivably rotates, the pogo pivot pin passing through the pogo bracket, the pogo base 513, and secured with pogo pin retaining clip 517. The pogo base has the aperture at its top through which pivot pins coupling the link bars of the compression mechanism pass. The pogo base has a channel for receiving a compression spring, as does the pogo top 512. A pogo spring guide passes into the compression spring. A set screw 518 retains the pogo top on the pogo base. Accordingly, it may be seen that the pogo is springably compressible. Pogo top 518 has a rounded end which engages with an interior surface of the CJ compression bar. As the pogo is raised through a plane 90 degrees to the CJ compression bar, it compresses slightly. Past the 90 degree plane it begins to expand by way of the internal compression spring. The pogo then stops at the top of its travel range. The compression through the 90 degree plane means that the compression jamb handle pressure required to close the system increases as the handle is turned until the pogo is nearly at the end of its travel (i.e. at the 90 degree point). Subsequent pressure applied to the compression jamb handle in conjunction with the compression spring and the curved surface of the pogo end against the CJ compression bar cause the pogo to snap into a closed position. The pogos essentially cam past the 90 degree point and provide haptic user feedback similar to a control lever passing a detent. In this way, the CJ compression bar is prevented from retracting without intentional input from a user via operating the compression jamb handle.

Figure 14A:
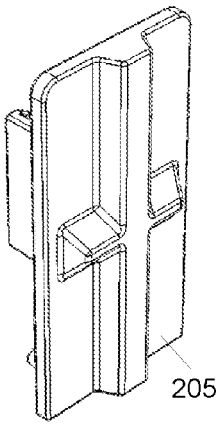
FIGS. 14*a* and 14*b* are perspective views of a male endcap and a female endcap.
Figure 14B:
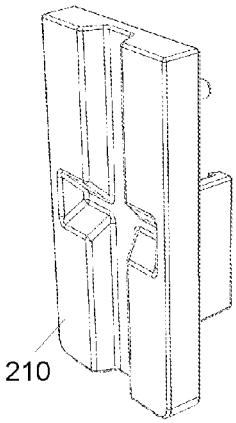

FIGS. 14*a* and 14*b* are perspective views of a male endcap and a female endcap, in accordance with an embodiment of the invention. In some embodiments, the male endcap 205 and female endcap 210 are disposed in mated pairs at the top and the bottom of the edges of adjacent slidable elements and/or at the top and bottom of the static jamb or the compression jamb. (See, e.g. FIGS. 1*i*, 7*b*, 12*a*-12*b* for examples of location of the endcaps.) It may be seen that the adjoining endcaps interlock, providing a tighter seal of adjacent panels or jambs. The endcap protrusions (male endcap) and recesses (female endcap) may have both a horizontal and a vertical orientation, as well as a ramped/sloped arrangement, in order to assist the adjacent panels or jambs to align more precisely as they are compressed together during operation of the compression jamb.

In some embodiments, when stacking the slidable elements, a "stack holder," which may be a low-profile right-angled piece affixed to the floor away from the movable closure system 100, acts as a guide whereby the front edge of each slidable element 102 rotates into position such that each front edge is lined up along the stack holder. Springs may be deployed within the stack holder for springably receiving the front edges of each slidable element 102. Upon stacking all the slidable elements 102, the aperture through the structure is fully open.

In some embodiments, the upper track and lower track are adjustable to better conform to the surfaces at the top and bottom of the aperture through the structure. For example, if a floor is not perfectly level, the lower track may be adjusted so that a top portion of the lower track is substantially level. This enables rectangular panels to hang from the upper glazing profile and upper track with plumb sides, such that the rectangular panels may move smoothly across the tracks with the lower hinge wheel assembly affixed to the underside of each slidable element also able to move smoothly across the lower track. As previously disclosed, the lower hinge wheel assembly may also be springably deployed such that the slidable elements float along the lower track even if a minor uneven condition exists. In some embodiments, two movable closure systems are installed adjacent to one another, each with its own stack but sharing at least one of the compression jamb, the static jamb, the adjustable upper track, or the adjustable lower track.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A movable closure system comprising:

an adjustable upper track including at least one laterally-disposed channel configured for receiving horizontal wheels; and at least one slidable element including one or more horizontal wheels received by the adjustable upper track, including at least:

at least one free wheel assembly;

at least one upper hinge wheel assembly including at least one locator pin; and at least one mechanism raising the at least one locator pin as the at least one slidable element is pivoted to open the at least one slidable element.

2. The movable closure system of claim 1, further comprising:

a lower track including at least one laterally-disposed channel configured for receiving horizontal wheels, wherein the at least one slidable element includes one or more horizontal wheels received by the lower track.

3. The movable closure system of claim 2, wherein the at least one slidable element including one or more horizontal wheels received by the lower track comprises:

at least one lower hinge wheel assembly, wherein the lower track is configured for receiving at least one crescent section of the at least one lower hinge wheel assembly as the at least one slidable element is pivoted to open the at least one slidable element.

4. The movable closure system of claim 2, wherein the lower track including at least one laterally-disposed channel configured for receiving horizontal wheels comprises:

a lower hinge block, the lower hinge block configured for receiving at least a portion of at least one horizontal wheel assembly as the at least one slidable element is pivoted to open the at least one slidable element.

5. The movable closure system of claim 1, wherein the adjustable upper track including at least one laterally-disposed channel configured for receiving horizontal wheels comprises:

an adjustable upper track configured for enabling the at least one free wheel assembly to exit the adjustable upper track as the at least one slidable element is pivoted to open the at least one slidable element.

6. The movable closure system of claim 1, wherein the adjustable upper track including at least one laterally-disposed channel configured for receiving horizontal wheels comprises:

an adjustable upper track configured for receiving the at least one locator pin of the at least one upper hinge wheel assembly as the at least one slidable element is pivoted to open the at least one slidable element.

7. The movable closure system of claim 1, wherein the at least one mechanism raising the at least one locator pin as the at least one slidable element is pivoted to open the at least one slidable element comprises at least one mechanism raising the at least one locator pin as the at least one free wheel assembly exits the adjustable upper track.

8. The movable closure system of claim 1, wherein the at least one mechanism raising the at least one locator pin as the at least one slidable element is pivoted to open the at least one slidable element comprises at least one mechanism raising the at least one locator pin as the at least one free wheel assembly exits the adjustable upper track, the at least one locator pin received by a hinge block of the adjustable upper track as the at least one free wheel assembly exits the adjustable upper track.

9. The movable closure system of claim 1, wherein the adjustable upper track including at least one laterally-disposed channel configured for receiving horizontal wheels comprises:

an insert guide.

10. The movable closure system of claim 9, wherein the insert guide comprises:

at least one ramped surface of the insert guide, the at least one ramped surface engaging at least a portion of the at least one free wheel assembly as the at least one free wheel assembly exits the adjustable upper track to at least partially control the at least one locator pin.

11. The movable closure system of claim 1, wherein the adjustable upper track including at least one laterally-disposed channel configured for receiving horizontal wheels comprises:

an upper load wheel channel; and a lower load wheel channel, wherein the at least one free wheel assembly of the at least one slidable element includes at least one lower load wheel configured for traversing the lower load wheel channel, and wherein the at least one hinge wheel assembly of the at least one slidable element includes at least one lower load wheel configured for traversing the lower load wheel channel and at least one upper load wheel configured for traversing the upper load wheel channel.

12. The movable closure system of claim 11, wherein the adjustable upper track including at least one laterally-disposed channel configured for receiving horizontal wheels comprises:

at least one insert guide, wherein the at least one insert guide is configured for permitting a free wheel assembly to traverse the at least one insert guide to exit the adjustable upper track, the at least one insert guide configured for restricting a hinge wheel assembly from traversing the at least one insert guide or exiting the adjustable upper track.

13. The movable closure system of claim 1, wherein the adjustable upper track including at least one laterally-disposed channel configured for receiving horizontal wheels comprises:

an adjustable upper track including at least one laterally-disposed channel configured for receiving round-edged horizontal wheels.

14. The movable closure system of claim 1, wherein the at least one mechanism raising the at least one locator pin as the at least one slidable element is pivoted to open the at least one slidable element comprises at least one mechanism lowering the at least one locator pin as the at least one slidable element is pivoted to close the at least one slidable element.

15. The movable closure system of claim 1, wherein the at least one free wheel assembly comprises:

at least one button disposed to be engaged by at least one ramped surface of the adjustable upper track as the at least one slidable element is pivoted.

16. The movable closure system of claim 15, wherein the at least one button disposed to be engaged by at least one ramped surface of the adjustable upper track as the at least one slidable element is pivoted comprises:

at least one rounded top portion of the at least one button disposed to be engaged by at least one ramped surface of the insert guide of the adjustable upper track as the at least one slidable element is pivoted.

17. The movable closure system of claim 1, wherein the at least one free wheel assembly comprises:

a clicker.

18. The movable closure system of claim 1, wherein the at least one mechanism raising the at least one locator pin as the at least one slidable element is pivoted to open the at least one slidable element comprises at least one pushrod in physical communication with the at least one free wheel assembly and with the at least one hinge wheel assembly.

19. A movable closure system comprising:

an adjustable upper track including at least:

at least one laterally-disposed channel configured for receiving horizontal wheels;

a hinge block; and at least one insert guide including at least one ramped surface; and at least one slidable element including one or more horizontal wheels received by the adjustable upper track, including at least:

at least one free wheel assembly; and at least one upper hinge wheel assembly in physical communication with the at least one free wheel assembly via at least one pushrod, wherein the at least one pushrod drives at least one locator pin of the at least one upper hinge wheel assembly into the hinge block upon pivoting to open the at least one slidable element, the at least one pushrod engaged by the at least one free wheel assembly during pivoting to open the at least one slidable element when at least a portion of the at least one free wheel assembly contacts the at least one ramped surface of the at least one insert guide.

20. A movable closure system comprising:

an adjustable upper track including at least one laterally-disposed channel configured for receiving horizontal wheels; and at least one slidable element including one or more horizontal wheels received by the adjustable upper track, including at least:

at least one free wheel assembly including at least one clicker; and at least one upper hinge wheel assembly including at least one locator pin, wherein the at least one clicker includes at least one cam and spring arrangement operable to lock the at least one locator pin in a raised position as the at least one slidable element is pivoted to open the at least one slidable element, the at least one clicker unlocking to permit the at least one locator pin to drop as the at least one slidable element is pivoted to close the at least one slidable element.

* * * * *